US005531806A

United States Patent [19]

Webster

[11] Patent Number: 5,531,806

[45] Date of Patent: Jul. 2, 1996

[54] MAGNESIUM-LITHIUM ALLOYS OF HIGH TOUGHNESS

[75] Inventor: Donald Webster, Saratoga, Calif.

[73] Assignee: Comalco Aluminium Limited, Melbourne, Australia

[21] Appl. No.: 424,794

[22] Filed: Apr. 19, 1995

Related U.S. Application Data

[60] Division of Ser. No. 76,117, Jun. 14, 1993, Pat. No. 5,422,066, which is a continuation-in-part of Ser. No. 946,245, Sep. 17, 1992, abandoned, and Ser. No. 771,907, Oct. 4, 1991, Pat. No. 5,320,803, which is a continuation-in-part of Ser. No. 328,364, Mar. 24, 1989, Pat. No. 5,085,830, said Ser. No. 946,245, is a continuation-in-part of Ser. No. 328,364.

[51] Int. Cl.[6] ..... C22B 26/00

[52] U.S. Cl. ..... 75/594; 75/600; 148/406; 148/420; 420/402; 420/407; 420/590

[58] Field of Search ..... 420/402, 407, 420/590; 148/406, 420; 75/594, 600

[56] References Cited

FOREIGN PATENT DOCUMENTS 130985 7/1946 Australia ..... 420/402

*Primary Examiner*—Melvyn Andrews
*Assistant Examiner*—Robert R. Koehler
*Attorney, Agent, or Firm*—Nikaido, Marmelstein, Murray & Oram

[57] ABSTRACT

A process for preparing a high strength magnesium alloy comprising heating a melt comprised of a base metal of magnesium, greater than 0.5% of lithium, and at least one alkali metal impurity selected from the group consisting of sodium, potassium, rubidium and cesium, the total alkali metal present in an amount greater than 5 ppm, to a temperature of about 50° to 200° C. above the melting point of alloy being refined in a vacuum for a sufficient time to reduce the aggregate concentration of alkali metal impurities in the melt to less than about 5 ppm as measured by GDMS.

9 Claims, 19 Drawing Sheets

FIG. 27A
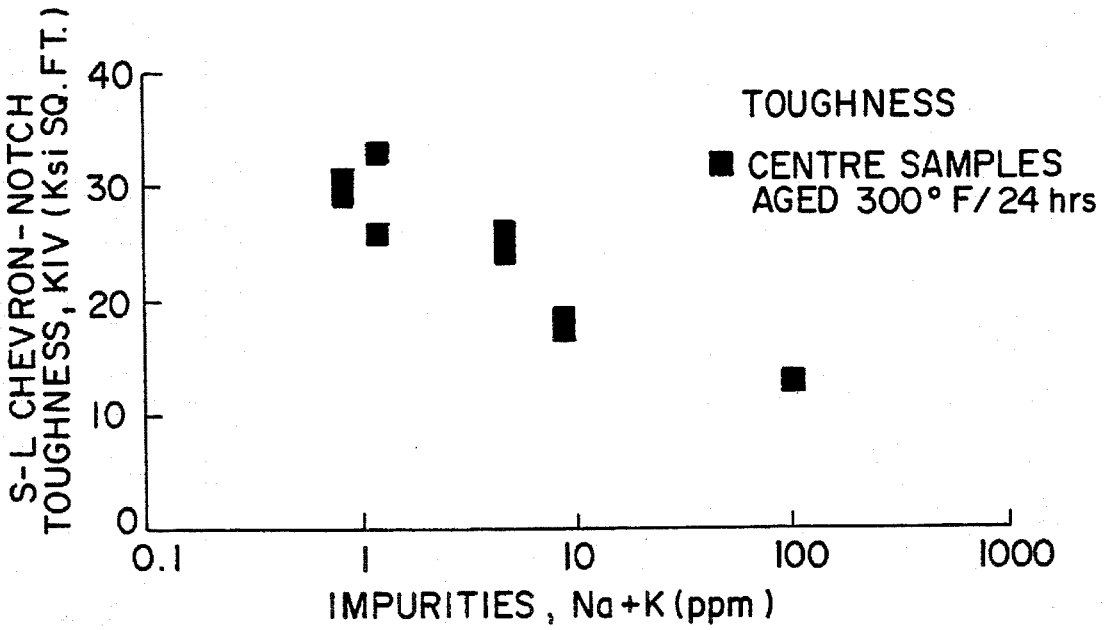
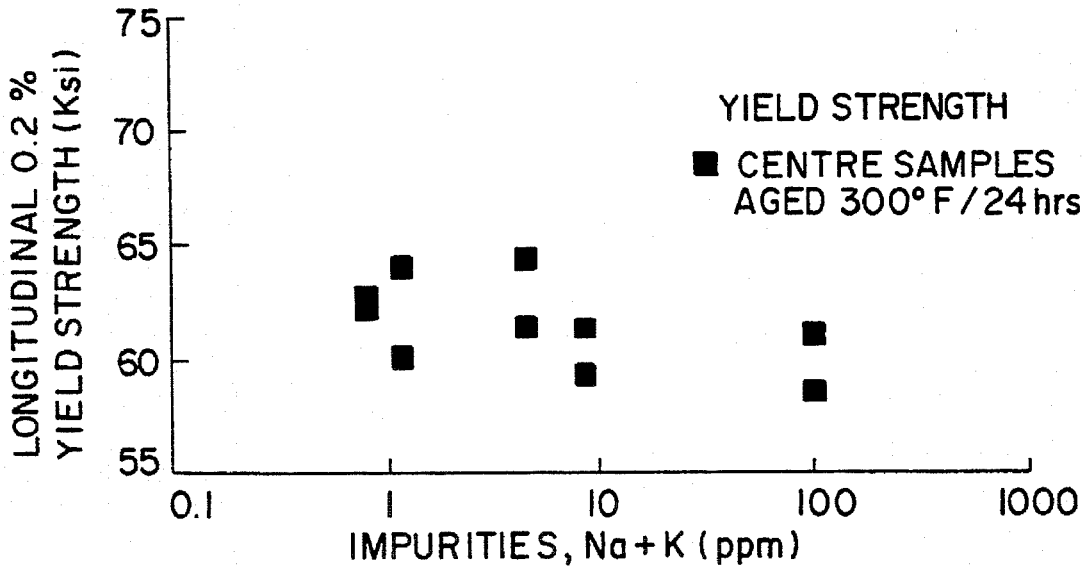
FIG. 27B

FIG. 28A
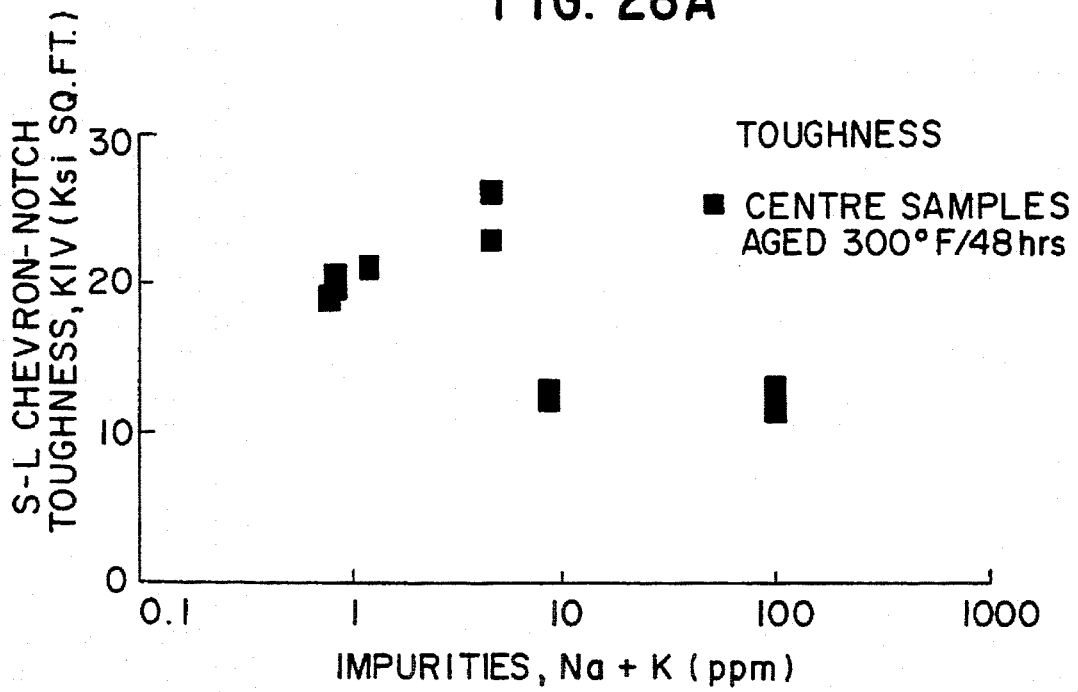
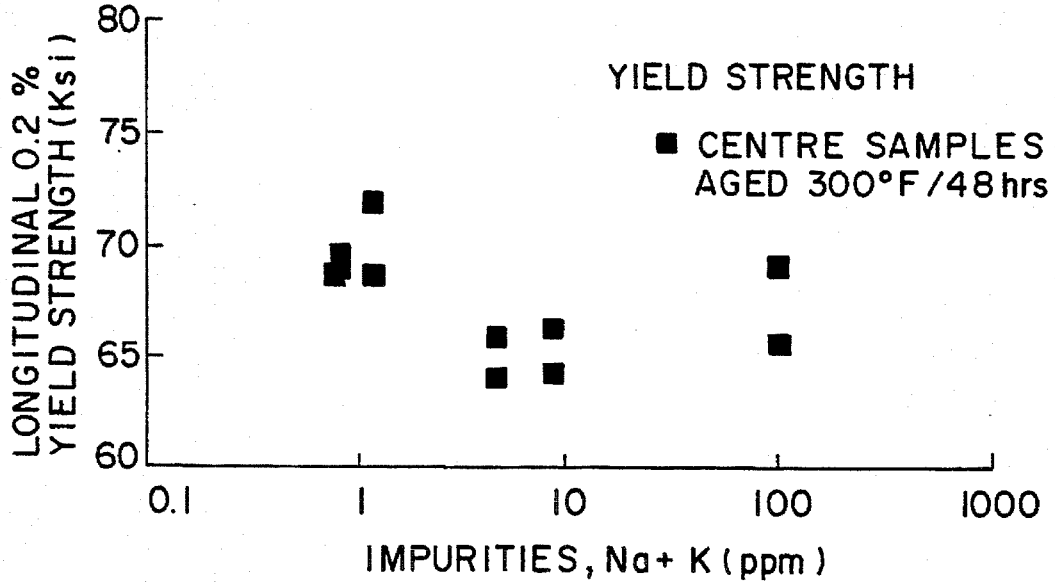
FIG. 28B

MAGNESIUM-LITHIUM ALLOYS OF HIGH TOUGHNESS

CROSS REFERENCE TO RELATED APPLICATIONS

This application is a divisional of U.S. application Ser. No. 08/076,117, filed Jun. 14, 1993, now U.S. Pat. No. 5,422,066, issued Jun. 6, 1995, which is a continuation-in-part of U.S. application Ser. No. 07/946,245, filed Sep. 17, 1992 (now abandoned), and a continuation-in-part of U.S. application Ser. No. 07/771,907, filed Oct. 4, 1991, now U.S. Pat. No. 5,320,803, issued Jun. 14, 1994, both of which were continuations-in-part of U.S. application Ser. No. 07/328,364, filed Mar. 24, 1989, now U.S. Pat. No. 5,085,830, issued Feb. 4, 1992. The disclosures of these applications are hereby incorporated by reference.

BACKGROUND OF THE INVENTION

High strength aluminum alloys and composites are required in certain applications, notably the aircraft industry where combinations of high strength, high stiffness and low density are particularly important. High strength is generally achieved in aluminum alloys by combinations of copper, zinc and magnesium. High stiffness is generally achieved by metal matrix composites such as those formed by the addition of silicon carbide particles or whiskers to an aluminum matrix. Recently Al-Li alloys containing 2.0 to 2.8% Li have been developed. These alloys possess a lower density and a higher elastic modulus than conventional non-lithium containing alloys.

The preparation and properties of aluminum based alloys containing lithium are widely disclosed, notably in J. Stone & Company, British Patent No. 787,665 (Dec. 11, 1957); Ger. Offen. 2,305,248 (National Research Institute for Metals, Tokyo, Jan. 24, 1974); Raclot U.S. Pat. No. 3,343,948 (Sep. 26, 1967); and Peel et al British Patent 2,115,836 (Sep. 14, 1983).

Unfortunately, high strength aluminum-lithium alloys are usually characterized by low toughness, as evidenced by impact tests on notched specimens (e.g., Charpy tests, see: Metals Handbook, 9th Ed., Vol. 1, pp. 689–691) and by fracture toughness tests on fatigue precracked specimens where critical stress intensity factors are determined.

There have been two basic techniques used to improve the toughness of Al-Li alloys.

1. Techniques commonly used for other aluminum alloys, such as alloying (Cu, Zn, Mg), stretching 1 to 5% before aging to refine precipitation, control of recrystallization and grain growth with Zr (0.1%) and the control of initial grain size by the use of powder metallurgy.
2. The production of dispersoids in amounts greater than needed for recrystallization control using 0.5 to 2% of Mn, Zr, Fe, Ti and Co to homogenize slip distribution.

In the last 10 years, these methods have had some success but the toughness of Al-Li alloys still falls short of that of conventional aluminum alloys.

Conventional techniques, for improving the toughness of Al-Li alloys, have not included the use of a vacuum melting and refining treatment. Aluminum alloys which are typically melted in air; although, vacuum melting is used by some manufacturers of high quality aluminum investment castings, such as Howmet Turbine Components Corporation who make castings of A357 and A201, to avoid dross formation (G. K. Bouse and M. R. Behrendt, "Advanced Casting Technology Conference", edited by Easwaren, published by ASM, 1987).

Howmet has also made experimental Al-Li-Cu-Mg investment castings by vacuum melting (Proceedings of the Al-Li Alloys Conference, held in Los Angeles, March 1987, pp. 453–465, published by ASM International) to reduce reactions between lithium and air to reduce hydrogen pickup which occurs when lithium reacts with moisture in the air. Commercial Al-Li alloys are usually melted under an argon atmosphere which accomplishes these objectives less efficiently than vacuum but is an improvement over air melting.

Al-Li alloys, although having many desirable properties for structural applications such as lower density, increased stiffness and slower fatigue crack growth rate compared to conventional aluminum alloys, are generally found to have the drawback of lower toughness at equivalent strength levels.

Conventional high strength Al-Li alloys have resistance to stress-corrosion cracking in the short transverse (S-T) direction less than about 200 Mpa (29 Ksi) in the peak aged to overaged condition, e.g., alloy 7075 has a threshold stress for stress corrosion cracking in the S-T direction in the range of about 300 Mpa (42 Ksi) in the T73 condition to about 55 Mpa (8 Ksi) in the T6 condition.

ADVANTAGES AND SUMMARY OF THE INVENTION

Advantages of the subject invention are that it provides a simple, versatile and inexpensive process for improving the toughness of Al-Li, Al-Mg and Mg-Al alloys that is effective on both virgin and scrap source alloys.

Another advantage of the subject invention is that it avoids formation and incorporation of various metal oxides and other impurities commonly associated with, e.g., powder metallurgy techniques, that involve heating and/or spraying the product alloy in air or other gases.

It has now been discovered that an improved combination of high strength, high toughness and good ductility can be obtained in aluminum alloys containing primary alloying elements selected from the group consisting of Li and Mg by processing the alloys in the molten state under conditions that reduce alkali metal impurities (AMI), i.e., (Na, K, Cs, Rb) content. The processing technique involves subjecting the molten alloy to conditions that remove alkali metal impurity, e.g., a reduced pressure for a sufficient time to reduce the concentration of each alkali metal impurity to less than about 1 ppm, preferably, less than about 0.1 ppm and most preferably less than 0.01 ppm.

As noted above, the process also beneficially reduces the gas (hydrogen and chlorine) content of the alloys which is expected to provide an additional improvement in quality by reducing the formation of surface blisters and giving superior environmentally controlled properties such as stress corrosion resistance. Preferably, the hydrogen concentration is reduced to less than about 0.2 ppm, more preferably, less than about 0.1 ppm. Preferably, the chlorine concentration is reduced to less than about 1.0 ppm, more preferably less than about 0.5 ppm.

The alloys of this invention may be used to make high strength composite materials by dispersing particles such as fibers or whiskers of silicon carbide, graphite, carbon, aluminum oxide or boron carbide therein. The term aluminum based metallic product is sometimes used herein to refer generally to both the alloys and alloy composites of the invention.

The present invention also provides improved Mg-Li alloys, for example, the experimental alloy LA141A, comprising magnesium base metal, lithium primary alloying element and less than about 1 ppm, preferably less than about 0.1 ppm, and most preferably less than about 0.01 ppm of each alkali metal impurity selected from the group consisting of sodium, potassium, rubidium and cesium. As with the Al-Li and Al-Mg alloys described above, the hydrogen concentration is preferably less than about 0.2 ppm, more preferably less than about 0.1 ppm, and the chlorine concentration is preferably less than about 1.0 ppm, and more preferably less than about 0.5 ppm.

The Mg-Li alloys typically include about 13.0 to 15.0% lithium and about 1.0 to 1.5% aluminum, preferably about 14.0% lithium and about 1.25% aluminum. The Mg-Li of this invention can be made by the process described above in connection with the Al-Li and Al-Mg alloys.

BRIEF DESCRIPTION OF THE DRAWINGS

FIGS. 27A, 27B, 28A, and 28B show yield strength and toughness as a function of impurity level.

DETAILED DESCRIPTION OF THE INVENTION

Figure 1:
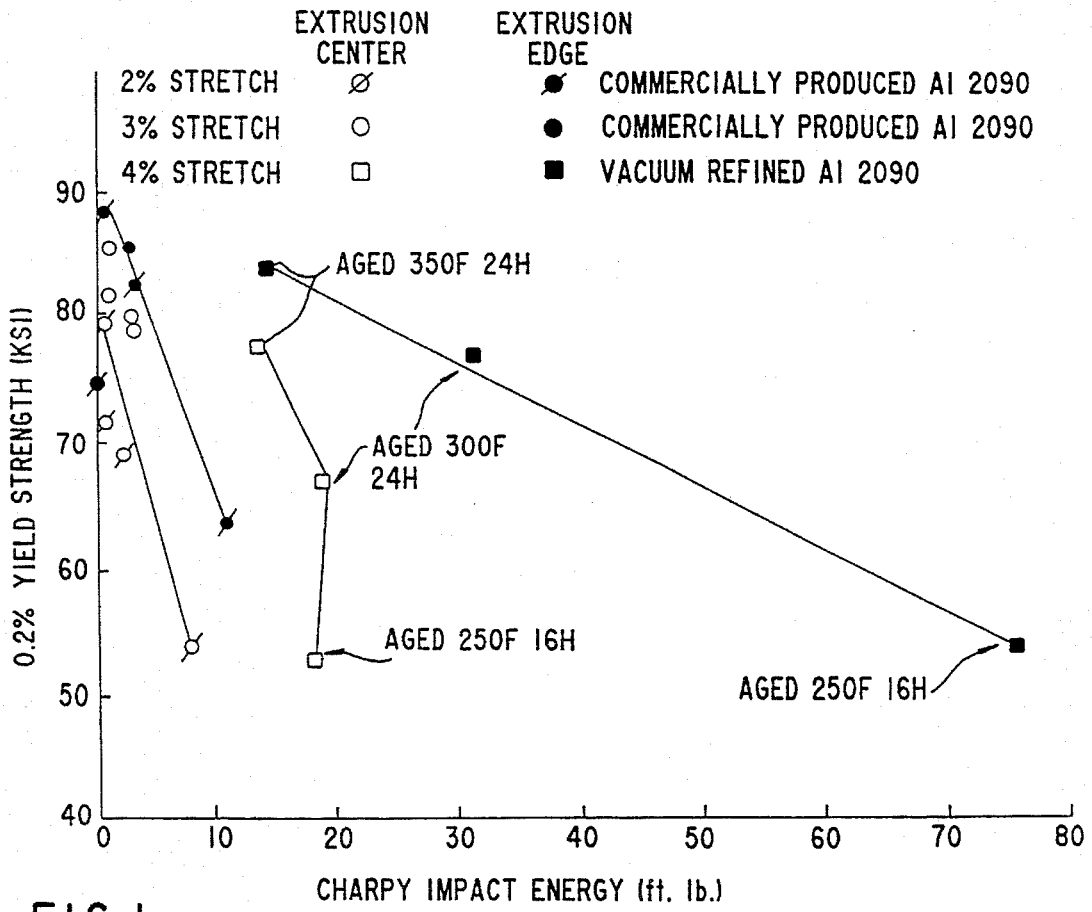
FIG. 1 is a plot of 0.2% tensile yield strength versus the Charpy impact energy at each strength level from a commercially produced A12090 alloy and a vacuum refined A12090 alloy produced by the process described herein. Property measurements are taken from both the center one third of the extrusion and the outer one third of each extrusion.

The present invention is applicable to aluminum based metallic materials containing lithium or magnesium as a primary alloying element and magnesium base of metallic materials including lithium, including both alloys and composites. The term "primary alloying element" as used herein means lithium or magnesium in amounts no less than about 0.5%, preferably no less than 1.0% by weight of the alloy. These materials can have a wide range of composition and can contain in addition to lithium or magnesium any or all of the following elements: copper, magnesium or zinc as primary alloying elements. All percents (%) used herein mean weight percent (wt. %) unless otherwise stated.

Examples of high strength composites to which the present invention is also applicable include a wide range of products wherein Al-Li, Al-Mg and Mg-Li matrices are reinforced with particles, such as whiskers or fibers, of various materials having a high strength or modulus. Examples of such reinforcing phases include boron fibers, whiskers and particles; silicon carbide whiskers and particles, carbon and graphite whiskers and particles; and aluminum oxide whiskers and particles.

Examples of metal matrix composites to which the present invention is applicable also include those made by ingot metallurgy where lithium and magnesium are important alloying elements added for any or all of the following benefits, lower density, higher stiffness or improved bonding between the matrix and the ceramic reinforcement or improved weldability. The benefits conferred by the present invention on Al-Li, Al-Mg and Mg-Li composite materials are similar to those conferred to the corresponding alloys themselves, particularly a combination of improved properties including higher toughness and ductility. Modern commercial Al-Li and Al-Mg alloys generally have a total (AMI) content of less than about 10 ppm which is introduced as impurity in the raw materials used for making the alloys. Mg-Li alloys also have high AMI contents corresponding to the larger proportions of lithium used therein.

Typically, a major portion of AMI contamination comes from the lithium metal which often contains about 50 to 100 ppm of both sodium and potassium. Since Al-Li alloys usually contain about 2 to 2.8% Li, the amount of sodium or potassium contributed by the lithium metal is usually in the range of about 1 to 2.8 ppm. Additional AMI can be introduced through chemical attack by the Al-Li on the refractories used in the melting and casting processes. Therefore, a total AMI content of about 5 ppm would not be unusual in commercial Al-Li ingots and mill products. AMI exist in Al-Li alloys as grain boundary liquid phases (Webster, D. Met. Trans. A, Vol. 18A, December 1987, pp. 2181–2193) which are liquid at room temperature and can exist as liquids to at least the ternary eutectic of the Na-K-Cs system at 195° K (–78° C.). These liquid phases promote grain boundary fracture and reduce toughness. An estimate of the loss of toughness can be obtained by testing at 195° K or below where all the liquid phases present at room temperature have solidified. When this is done, the toughness as measured by a notched Charpy impact test has been found to increase by up to four times.

The present invention exploits the fact that all the AMI have higher vapor pressures and lower boiling points than either aluminum, lithium, magnesium or the common alloying elements such as Cu, Zn, Zr, Cr, Mn and Si. This means that the AMI will be removed preferentially from alloys including these and similar elements when the alloys are maintained in the molten state under reduced pressure for a sufficient time. The first impurities to evaporate will be Rb and Cs followed by K with Na being the last to be removed. The rate of removal of the AMI from the molten Al-Li bath will depend on several factors including the pressure in the chamber, the initial impurity content, the surface area to volume ratio of the molten aluminum and the degree of stirring induced in the molten metal by the induction heating system.

In a preferred embodiment, an increase in the AMI evaporation rate may be obtained by purging the melt with an inert gas such as argon introduced into the bottom of the crucible through a refractory metal (Ti, Mo, Ta) or ceramic lance. The increase in removal rate due to the lance will depend on its design and can be expected to be higher as the bubble size is reduced and the gas flow rate is increased. The theoretical kinetics of the refining operation described above can be calculated for a given melting and refining situation using the principles of physical chemistry as for example those summarized in the Metals Handbook, Vol. 15, Casting, published in 1988 by ASM International.

The refining process is preferably carried out in a vacuum induction melting furnace to obtain maximum melt purity. However, in order to incorporate this technique into commercial Al-Li, Al-Mg and Mg-Li alloy production practice, the refining operation can take place in any container placed between the initial melting furnace/crucible and the casting unit, in which molten alloys can be maintained at the required temperature under reduced pressure for a sufficient time to reduce the AMI to a level at which their influence on mechanical properties, particularly toughness, is significantly reduced.

The process of the present invention may be operated at any elevated temperature sufficient to melt the aluminum base metal and all of the alloying elements, but should not exceed the temperature at which desired alloy elements are boiled off. Useful refining temperatures are in the range of about 50° to 200° C., preferably about 100° C., above the melting point of the alloy being refined. The optimum refining temperature will vary with the pressure (vacuum), size of the melt and other process variables.

The processing pressure (vacuum) employed in the process to reduce the AMI concentration to about 1 ppm or less, i.e., refining pressure, is also dependent upon process variables, including the size of the melt and furnace, agitation, etc. A useful refining pressure for the equipment used in the Examples hereof was less than about 200 μm Hg.

The processing times, i.e., the period of time the melt is kept at refining temperatures, employed in the process to reduce the AMI concentration to about 1 ppm or less are dependent upon a variety of factors including the size of the furnace, melt, melt temperature, agitation and the like. It should be understood that agitation with an inert gas as disclosed herein will significantly reduce processing times. Useful processing times for the equipment used in the Examples herein ranged from about 40 to 100 minutes.

It should be understood that the temperature, time and pressure variables for a given process are dependent upon one another to some extent, e.g., lower pressures or longer processing times may enable lower temperatures. Optimum time, temperature and pressure for a given process can be determined emperically.

The following examples are offered for purposes of illustration and are not intended to either define or limit the invention in any manner.

EXAMPLE 1

An A12090 alloy made by standard commercial practice was vacuum induction melted and brought to a temperature of about 768° C. under a reduced pressure of about 200 μm Hg. A titanium tube with small holes drilled in the bottom four inches of the tube was inserted into the lower portion of the molten metal bath and argon gas passed through the tube for five minutes. The gas was released well below the surface of the melt and then bubbled to the surface. The melt was then given a further refining period of about 50 minutes using only the reduced pressure of the vacuum chamber to reduce the AMI. The melt was grain refined and cast using standard procedures.

Five-inch diameter billets were extruded into a flat bar 1.77 inches by 0.612 inch thick. The composition of the original melt and the vacuum remelted material are given in Table I.

TABLE I

Chemical Analyses of Material Before and After Vacuum Refining

| Element | A12090 | A12090 Vacuum Refined | Analysis Technique | Analysis Units |
|---|---|---|---|---|
| Li | 1.98 | 1.96 | ICP | wt. % |
| Cu | 2.3 | 2.4 | ICP | wt. % |
| Zr | 0.13 | 0.13 | ICP | wt. % |
| Na | 3.2 | N.D. | ES | ppm |
| Na | 3.1 | 0.480 | GDMS | ppm |
| Na | ≠ | 0.480* | SIMS | ppm |
| K | 0.600 | 0.050 | GDMS | ppm |
| K | ≠ | 0.008 | SIMS | ppm |
| Cs | <<0.008 | <0.008 | GDMS | ppm |
| Cs | ≠ | 0.0115 | SIMS | ppm |
| Rb | 0.042 | <0.013 | GDMS | ppm |
| Rb | ≠ | .0005 | SIMS | ppm |
| Cl | 3.5 | 0.500 | GDMS | ppm |
| H (bulk) | 1.0 | 0.140 | LECO | ppm |

*SIMS analyses were standardized using GDMS and ES results.
ppm = parts per million
GDMS = glow discharge mass spectrometry
SIMS = secondary ion mass spectrometry
ES = emission spectrometry
LECO = hydrogen analysis by LECO Corporation, 300 Lakeview Ave., St. Joseph, MI 49085 U.S.A.-melting alloy under a stream of nitrogen gas and determining the hydrogen content by change in thermal conductivity.
≠ = not determined It can be seen that the desirable alloying element concentrations, i.e., Li, Cu and Zr, were substantially unchanged during the vacuum melting and refining process, but the undesirable impurities, Na, K, Rb, H and Cl, were markedly reduced. Since Cs was already below the detection limit of GDMS before the refining process began, no change in this element could be detected.

The Charpy impact toughness values of specimens produced from flat bar extrusions of the vacuum refined A12090 and specimens produced from a commercial A12090 alloy are compared as a function of 0.2% yield strength in FIG. 1. The strength-toughness combinations for the vacuum refined alloy surpass those of the commercial alloy at all strength levels and also exceed these property combinations of the usually superior conventional alloys, A17075 and A12024 (not shown).

The strength-toughness combinations of the extrusion edges are superior to those of the extrusion centers for this alloy and for the other alloys described in the examples below. This difference in properties occurs in extrusions of both Al-Li and conventional aluminum alloys and is related to a change in "texture" across the extrusion width. Texture in this case is meant to include grain size and shape, degree of recrystallization and preferred crystallographic orientation. The texture for the new Al-Li alloys is more pronounced than in commercial Al-Li alloys and conventional aluminum alloys. The degree of texture can be controlled by extrusion temperature, extrusion ratio and extrusion die shape.

EXAMPLE 2

Figure 2:
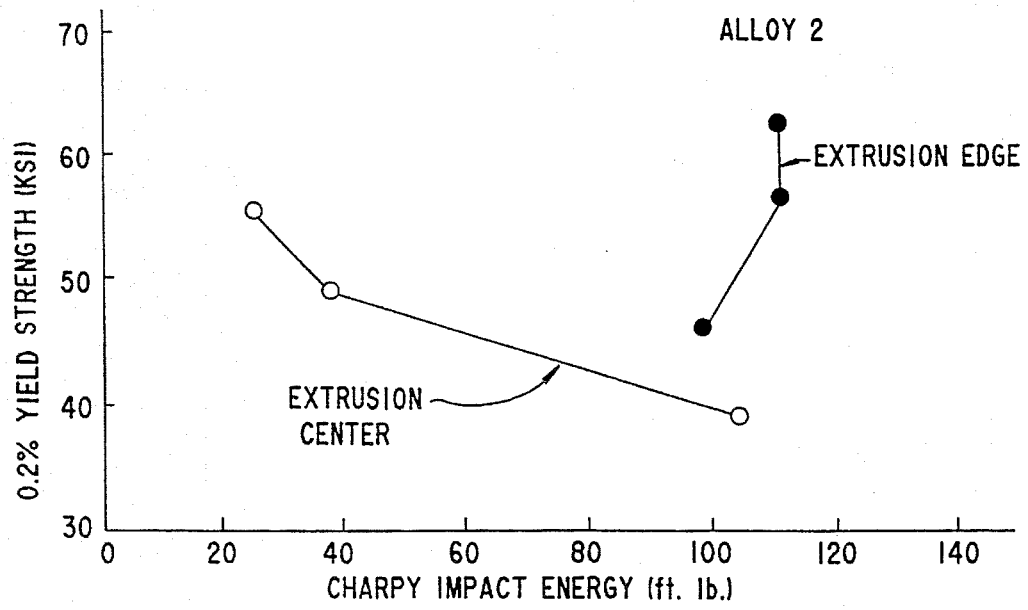
FIG. 2 is a plot of the 0.2% tensile yield strength versus the Charpy impact energy at each strength level for alloy 2 described in Example 2 and produced by the vacuum refining process described herein.

An alloy containing 1.8% Li, 1.14% Cu, 0.76% Mg and 0.08% Zr was given a vacuum refining treatment similar to that in Example 1 except that an argon lance was not used. It was then cast and extruded to flat bar and heat treated in the same manner as described in Example 1. The toughness properties (FIG. 2) again greatly exceed those of commercial Al-Li alloys at all strength levels. In many cases the toughness exceeds 100 ft. lbs. and is higher than that for most steels.

EXAMPLE 3

Figure 3:
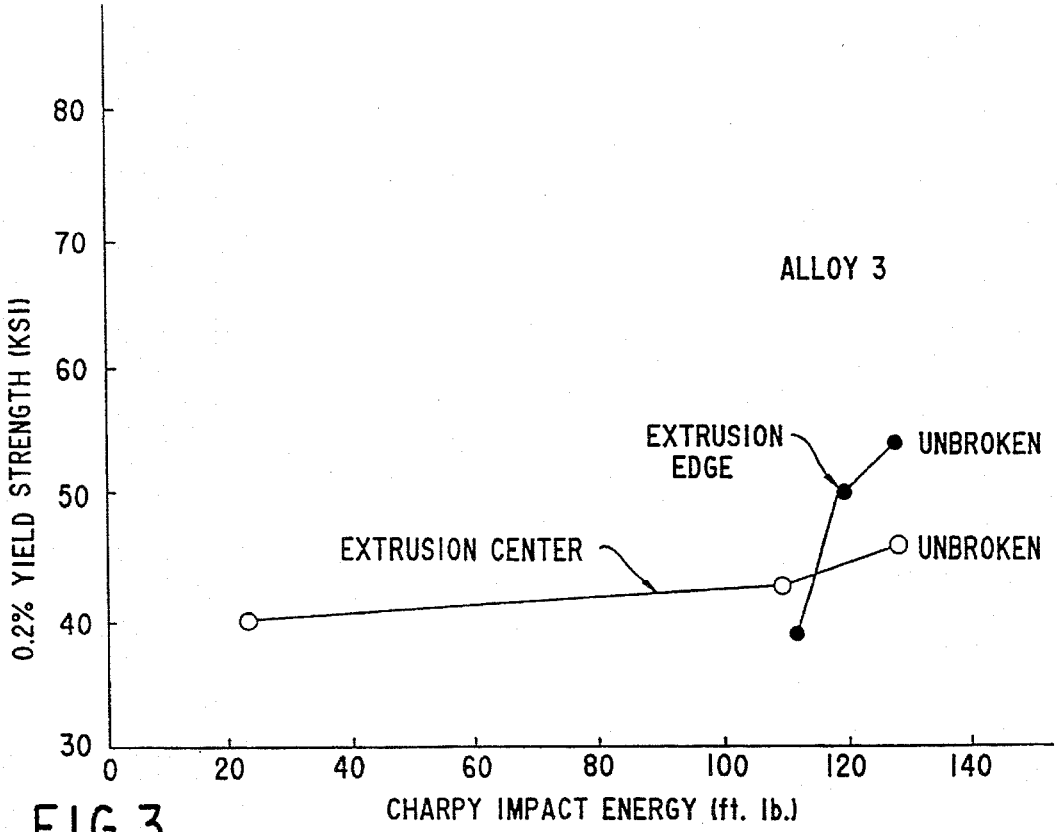
FIG. 3 is a plot of the 0.2% tensile yield strength versus the Charpy impact energy at each strength level for alloy 3 described in Example 3 and produced by the vacuum refining process described herein.

An alloy containing 2.02% Li, 1.78% Mg and 0.08% Zr was given a vacuum refining treatment similar to that described in Example 2. It was then extruded and heat treated and its strength and toughness were evaluated and are illustrated in FIG. 3. This specimen was so tough that it could not be broken on the 128 ft. Lb. Charpy testing machine capable of breaking specimens from almost all steel alloys.

EXAMPLE 4

Figure 4:
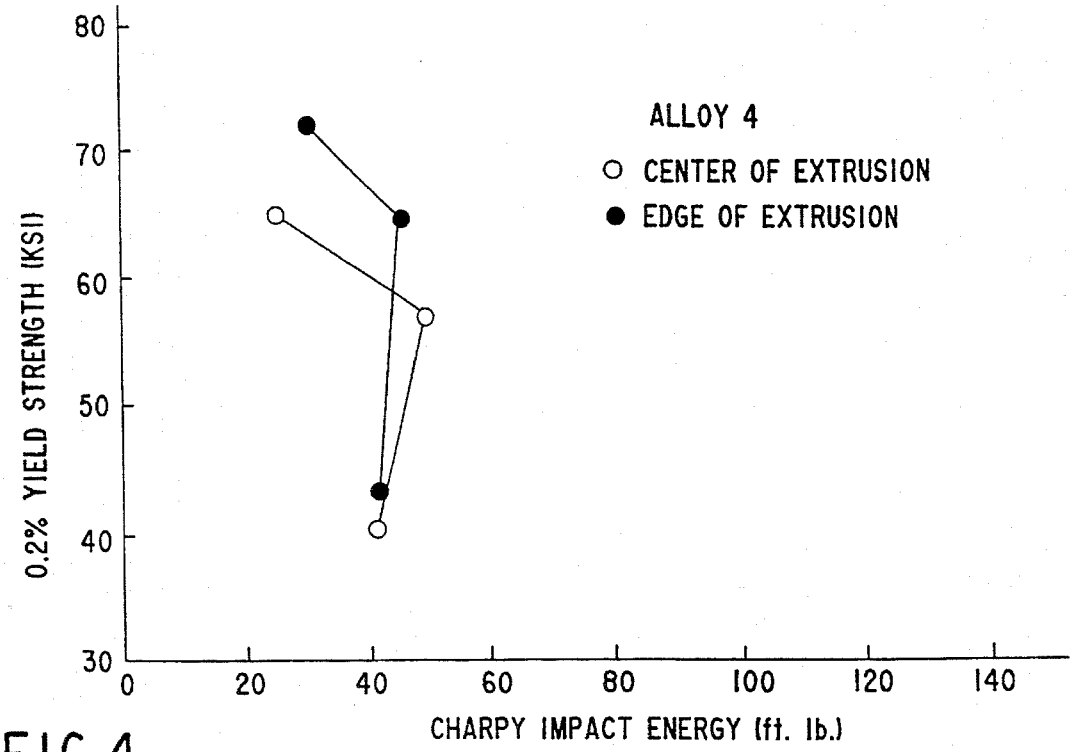
FIG. 4 is a plot of the 0.2% tensile yield strength versus the Charpy impact energy at each strength level for alloy 4 described in Example 4 and produced by the vacuum refining process described herein.

An alloy containing 2.4% Li, 0.88% Mg, 0.33% Cu and 0.18% Cr was given a vacuum refining treatment similar to that in Example 2. It was then extruded and heat treated and its strength and toughness were evaluated as in previous examples and illustrated in FIG. 4. Again, strength-toughness combinations greatly superior to those of conventional alloys were obtained.

EXAMPLE 5

Figure 5:
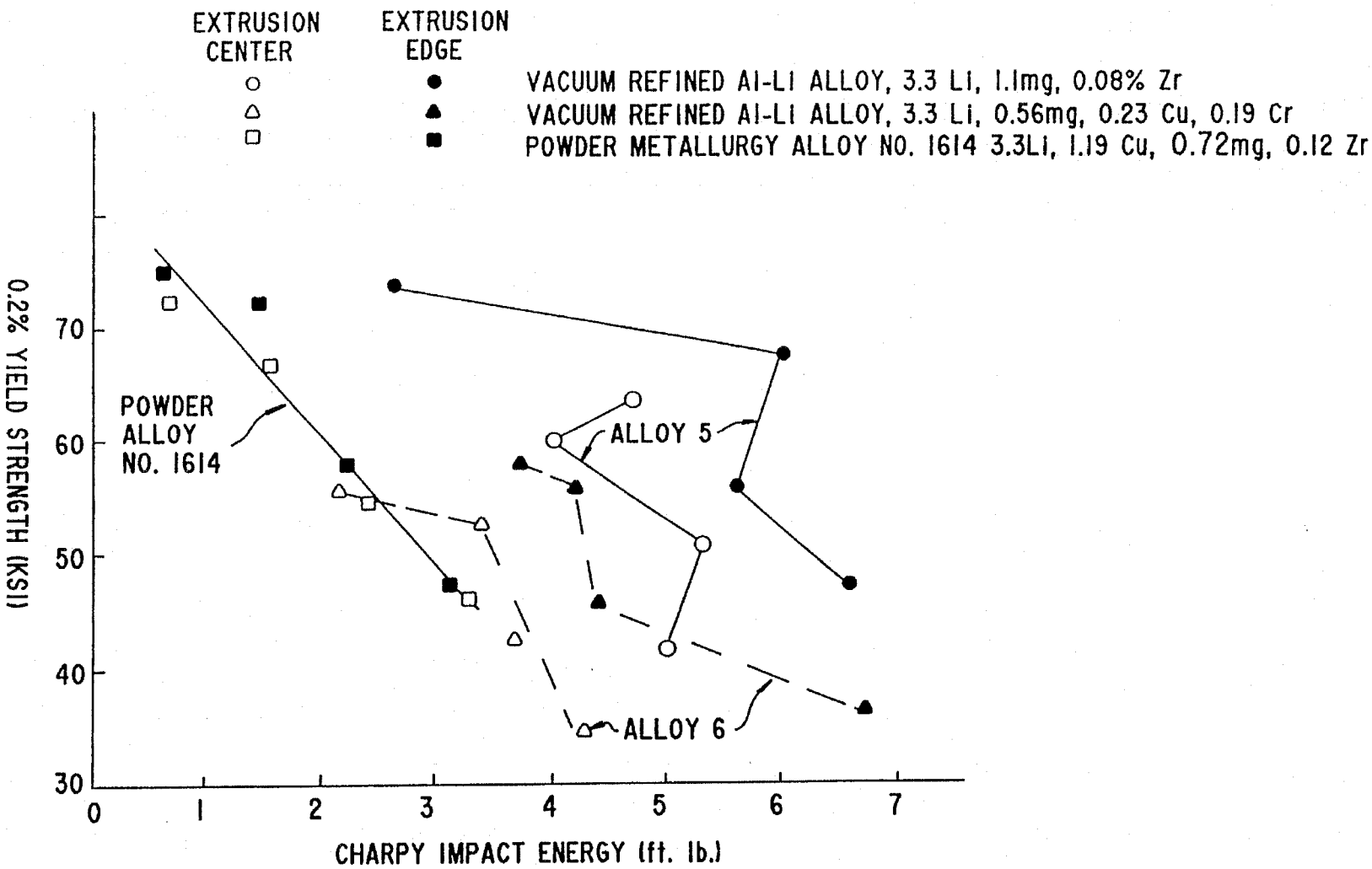
FIG. 5 is a plot of the 0.2% tensile yield strength versus the Charpy impact energy at each strength level for three alloys containing 3.3% Li and other alloying elements. Alloys 5 and 6 described in Example 5 were produced by the vacuum refining process described herein while alloy 1614 was produced by a powder metallurgy process and described in U.S. Pat. No. 4,597,792 and Met. Trans. A, Vol. 19Z, March 1986, pp. 603–615.

Two alloys (alloys 5 and 6) containing a higher than normal Li level (3.3% by weight) to obtain a very low density (0.088 lb/cu. In.) were given a vacuum refining treatment similar to that described in Example 2. The alloys were then cast, extruded and heat treated as in the previous examples. The strength-toughness combinations were evaluated and are shown in FIG. 5.

The high lithium level reduces the toughness compared to the alloys in Examples 1 to 4 but the properties are generally comparable to those of commercial Al-Li alloys and are superior to those of the much more expensive powder metallurgy alloys (U.S. Pat. No. 4,597,792, issued in 1986 to D. Webster) with the same lithium content as illustrated in FIG. 5. The compositions of the vacuum refined alloys described in this Example are:

Alloy 5—3.3% Li, 1.1% Mg, 0.08% Zr

Alloy 6—3.3% Li, 0.56% Mg, 0.23% Cu, 0.19% Cr

Alloy 7—2.9% Li, 1.02% Mg, 0.41% Cu, 0.1 Zr, 0.010 Fe, 0.112 Si and 4 ppm Na (not described).

EXAMPLE 6

Figure 6:
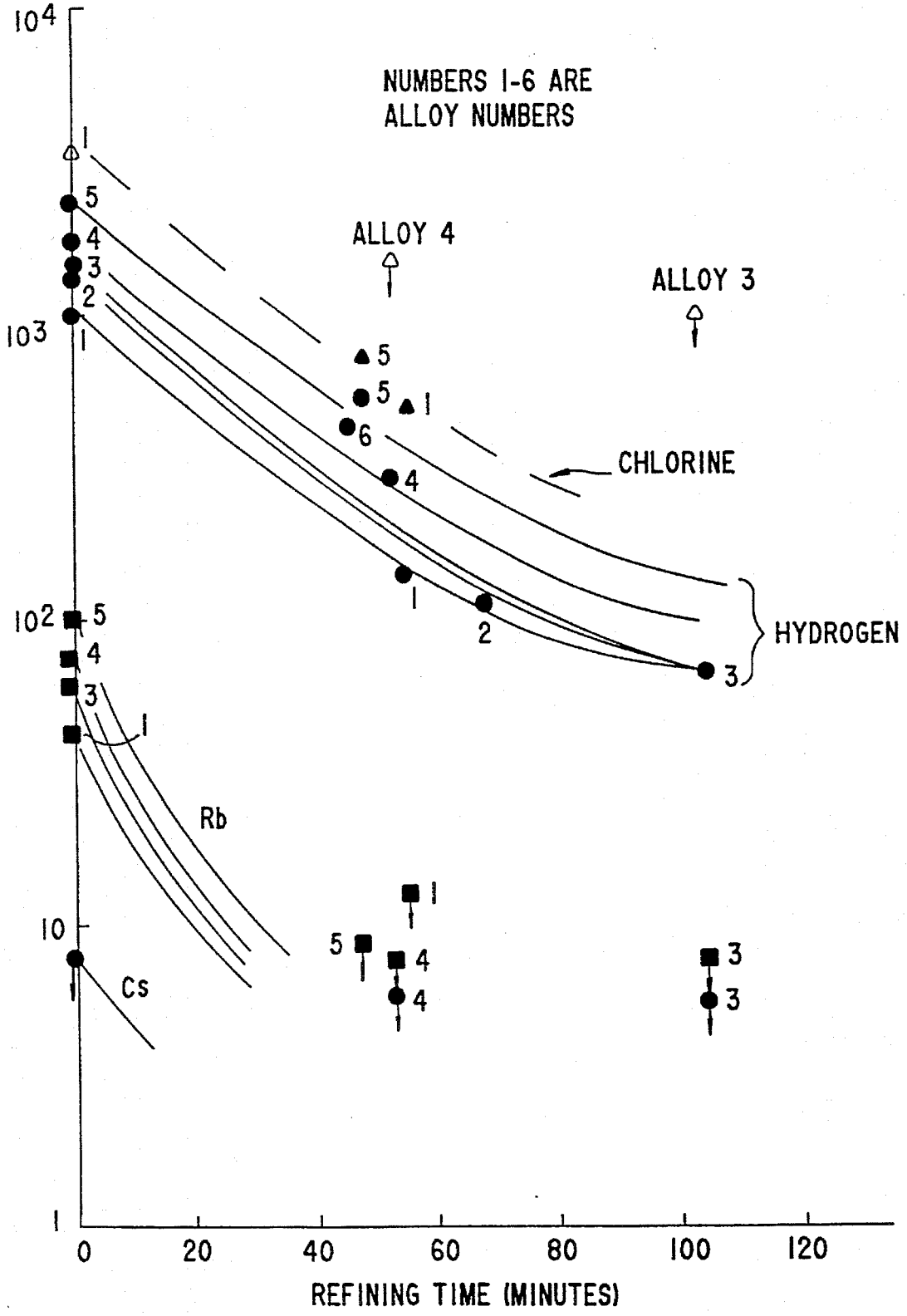
FIG. 6 is a plot of the concentration of H, Cl, Rb and Cs versus refining time for alloys 1 to 6.
Figure 7:
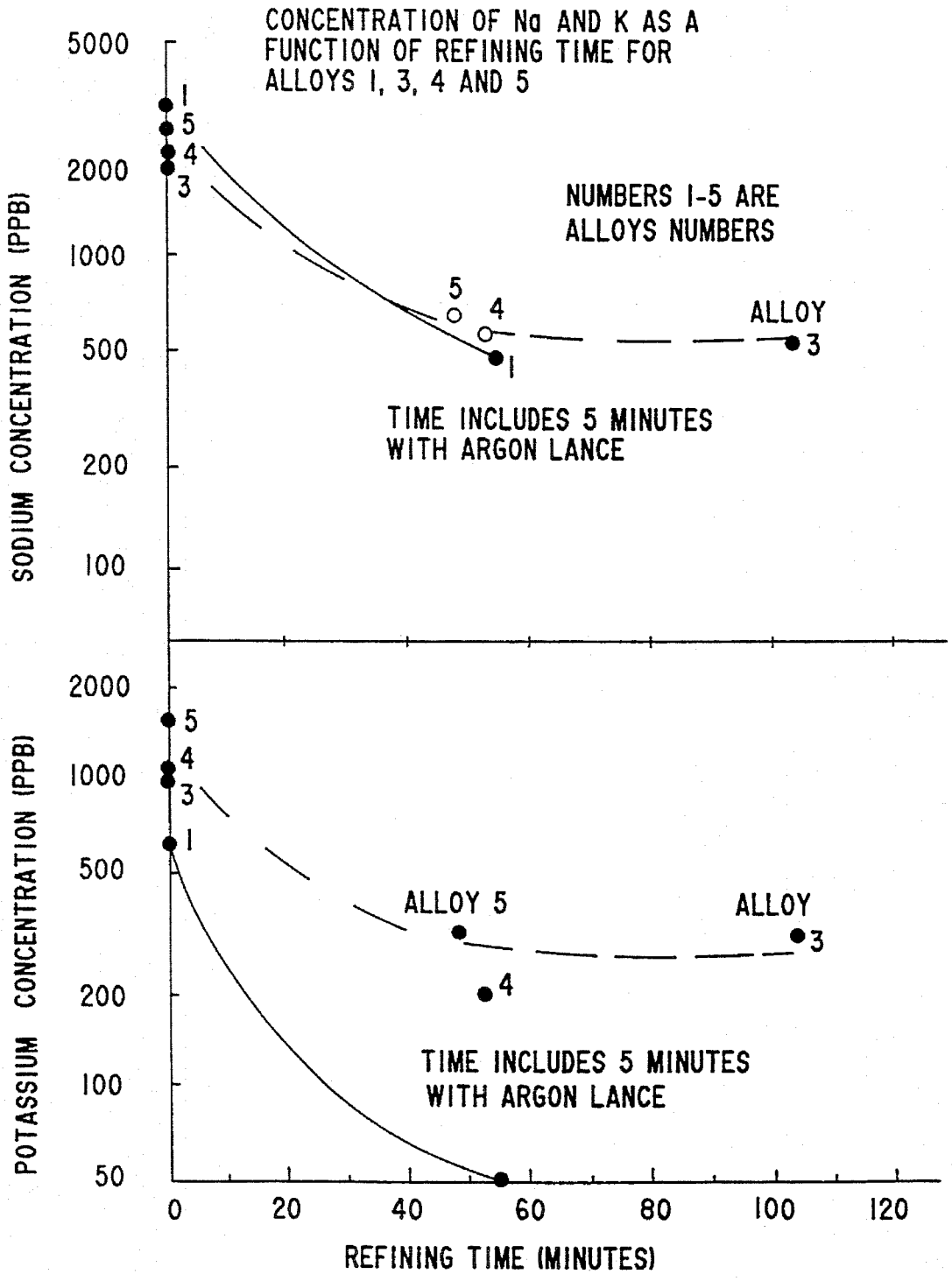
FIG. 7 is a plot of Na and K concentration versus refining time for alloys 1, 3, 4 and 5.

The above-described Alloys 1 to 6 were analyzed for AMI concentration after refining steps of varying duration. The results of those analyses are summarized in Table II below and illustrated in FIGS. 6 and 7. It should be noted that the inert gas lance described above was only used for refining Alloy 1, Example 1, which had the lowest final K and Na concentrations.

TABLE II

Chemical Composition as a Function of Refining Time

| | Impurity Concentration (PPB) | | | | | | Refining Time |
|---|---|---|---|---|---|---|---|
| Alloy | Na | K | Rb | Cs | H | Cl | (minutes) |
| 1. Start* | 3100 | 600 | 42 | <8 | 1000 | 3500 | |
| Finish | 480 | 50 | <13 | <8 | 140 | 500 | 55 |
| 2. Start* | | | | | 1350 | | |
| Finish | | | | | 120 | | 68 |
| 3. Start* | 2000 | 1000 | 60 | 5 | 1420 | | |
| Finish | 545 | 325 | <8 | <6 | 70 | 1044 | 104 |
| 4. Start* | 2200 | 1200 | 72 | 6 | 1700 | | |
| Finish | 602 | 206 | <8 | <6 | 300 | 1540 | 53 |
| 5. Start* | 2650 | 1650 | 100 | 8 | 2300 | | |
| Finish | 645 | 341 | <9 | <6 | 540 | 755 | 48 |
| 6. Start* | | | | | 3500 | | |
| Finish | | | | | 420 | | 46 |

*The start values are based on data published in D. Webster, Met. Trans. A, Vol. 18A, Dec. 1987, pp. 2181–2183.

Based on the above data, it is estimated that a minimum refining time of about 100 minutes is required to reduce the AMI to their equilibrium values (lowest attainable value). Although this estimate applies only to the melt used, i.e., about 100 lbs. In a 10-in diameter by 14-inch deep crucible, it illustrates how the effectiveness of the invention can be estimated.

EXAMPLE 7

Stress corrosion tests were performed on extruded lengths of the Al-Li Alloys 1, 3 and 4, described in the preceding examples. The purpose of the tests was to determine the threshold stress of stress corrosion cracking for each alloy in the S-T direction.

Ten tuning fork samples of each alloy (Alloys 1, 3 and 4) were machined from the center of the extrusions with a flat testing surface normal to the extrusion axis.

The specimens were loaded by deflecting the legs of the fork to predetermined stress levels between about 100 Mpa (i.e., 15 Ksi) and 450 (i.e., 65 Ksi) and subjected to alternate immersion testing in 3.5% NaCl solution in accordance with ASTM G44.

None of the specimens fractured during the 28-day testing period, regardless of the stress used.

Alloy 1 suffered general corrosion with numerous pits and initial examination of the pits indicated the possible presence of short cracks. Higher magnification metallographic examinations showed on stress corrosion crack on a sample tested at 380 Mpa (i.e., 55 Ksi) which had propagated about 80% through the section.

Alloy 3 suffered no general corrosion and its surface remained almost unchanged from the pretest conditions. Alloy 4 suffered no general corrosion and was only slightly stained on the surface.

Only Alloy 1 showed a threshold. Alloys 3 and 4 showed no failures at any of the test stress levels.

Figure 8:
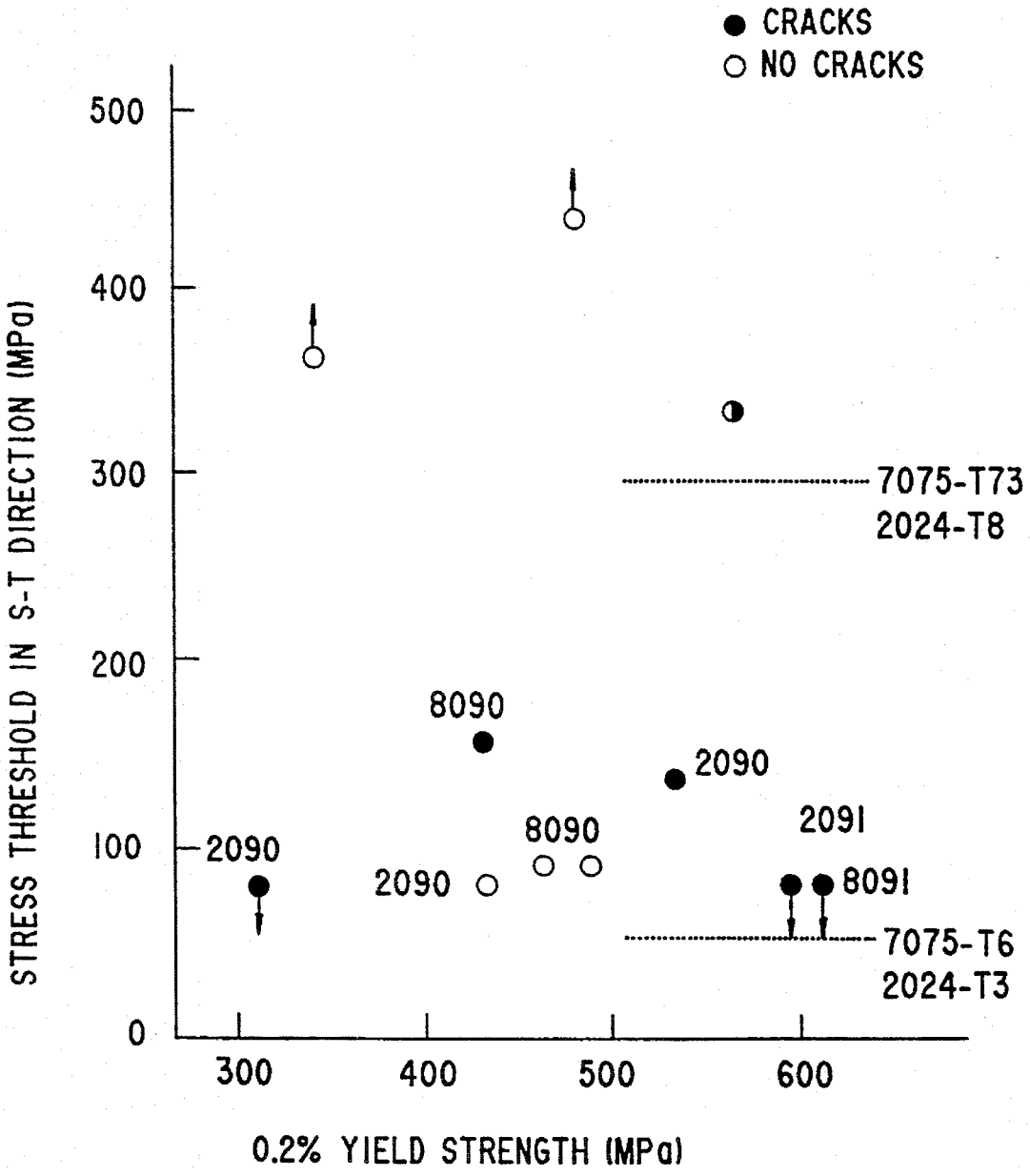
FIG. 8 is a plot comparing the stress corrosion resistance of alloys 1, 3 and 4 of the invention to conventional Al-Li alloys.

The stress corrosion cracking threshold stress for conventional Alloys 7075 and 2024 are shown in FIG. 8.

EXAMPLE 8

The weldability of Alloys 1 to 5 of the invention was evaluated by a Varestraint test using augmented strains of up to 4%. The test subjected the weld pool to controlled amounts of strain during welding. The total crack length and maximum crack length were measured and plotted against augmented strain in FIG. 9 to obtain comparative weldabilities for the different alloys.

The Varestraint tests were performed using a gas tungsten arc welding technique with constant welding parameters and augmented strains of 0.5%, 1.0% and 4.05. Specimens of 5-inch length were cut from extruded lengths and machined to ½-inch thickness. Prior to welding, each specimen was degreased and etched to remove oxidation. One specimen of each of Alloys 1 to 5 was tested at each strain.

Following the Varestraint test, all specimens were trimmed, ground and polished to reveal weld metal hot tears on the top surface. These cracks were then evaluated for maximum length and total accumulative crack length.

Figure 9:
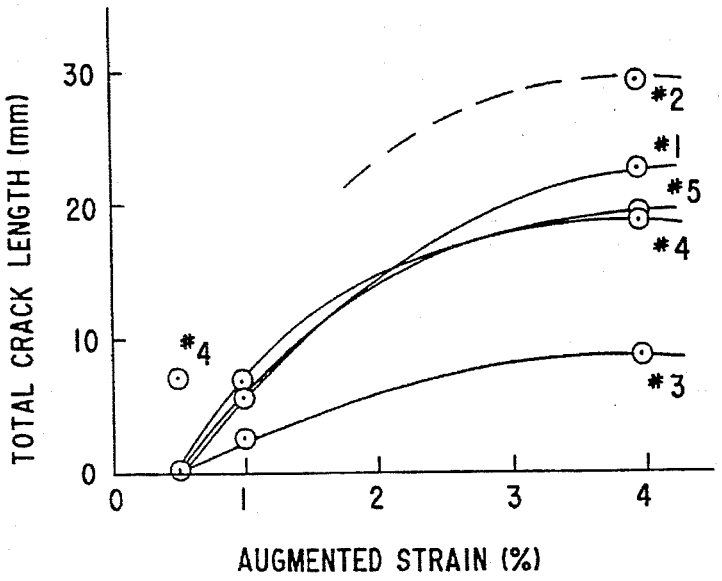
FIG. 9 is a plot of total crack length versus augmented strain from Table II.
Figure 11:
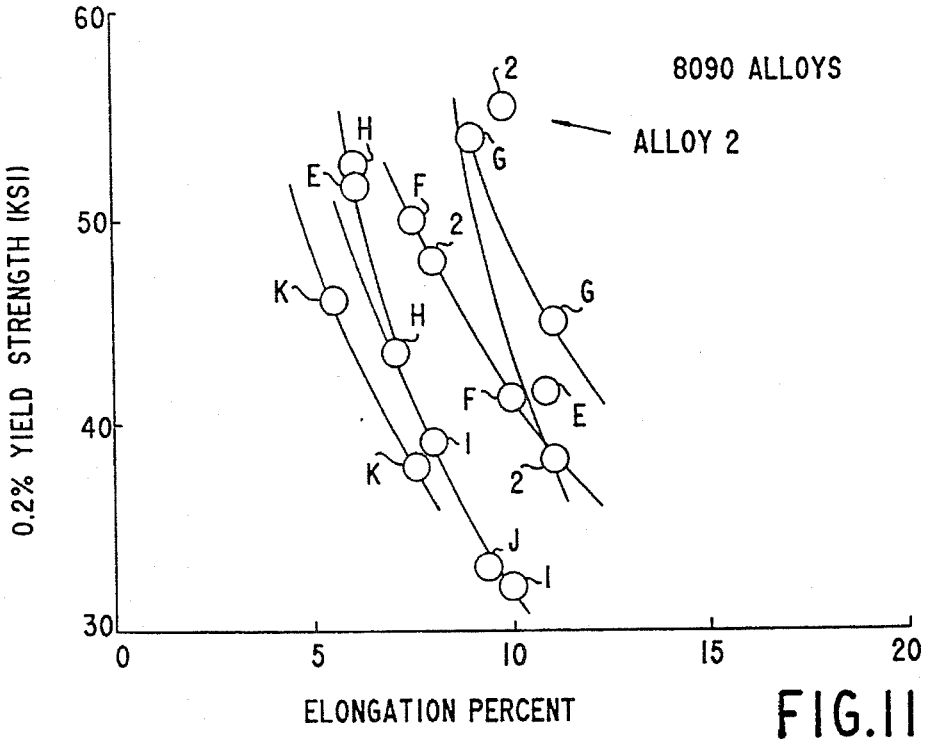
FIGS. 11 to 14 are plots of percent yield strength versus elongation for several 2090 and 8090 type Al-Li alloys having various alkali metal impurity levels for alloys 1(2090), 2(8090) and E to P.
Figure 12:
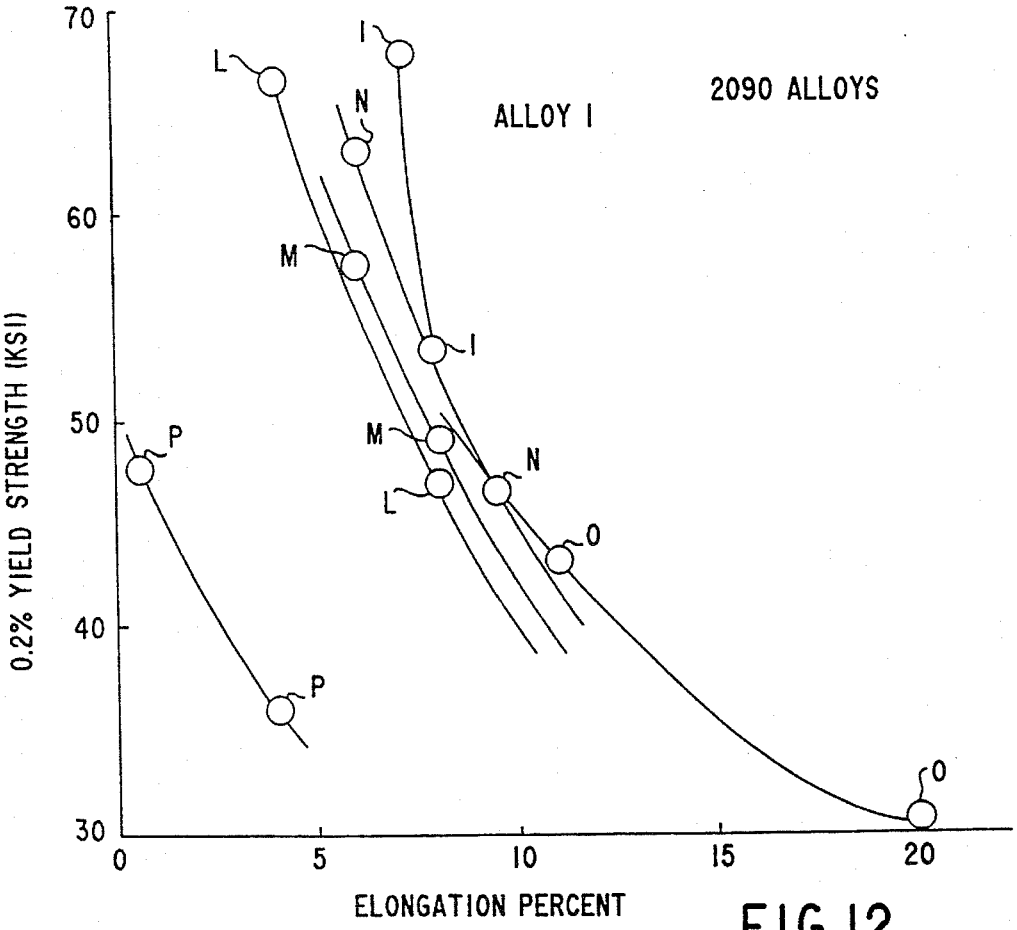

Results of the tests are presented in Table III below and in FIG. 9. It is believed that the 1% strain data best represents the likely behavior of these alloys under normal welding conditions. At 1% strain, the alloys can be rated, with Alloy 3 having the best performance, Alloy 2 having the worst performance and Alloys 1, 4 and 5 having intermediate performance to Alloys 3 and 2.

TABLE III

| | Varestraint (crack lengths in mm) Test Data | | | | | |
|---|---|---|---|---|---|---|
| | 0.5% Strain | | 1.0% Strain | | 4.0% Strain | |
| Alloy | MCL | TCL | MCL | TCL | MCL | TCL |
| 1 | 0.06 | 0.06 | 1.05 | 5.47 | 2.47 | 22.5 |
| 2 | — | — | — | —* | 4.55 | 28.9 |
| 3 | 0.00 | 0.00 | 0.82 | 2.48 | 1.95 | 8.5 |
| 4 | 1.82 | —** | 1.95 | 7.15 | 2.84 | 18.7 |
| 5 | 0.00 | 0.00 | 1.83 | 6.13 | 3.36 | 19.2 |

*centerline cracks were observed along the entire length of the weld.
Bad data point Varestraint weldability test data is presented in FIG. 10** for Alloys 1 to 4, commercial Al-Li alloy 2090, "Weldalite™" Al-Li alloy and conventional weldable aluminum alloys 2014 and 2219.

Figure 10:
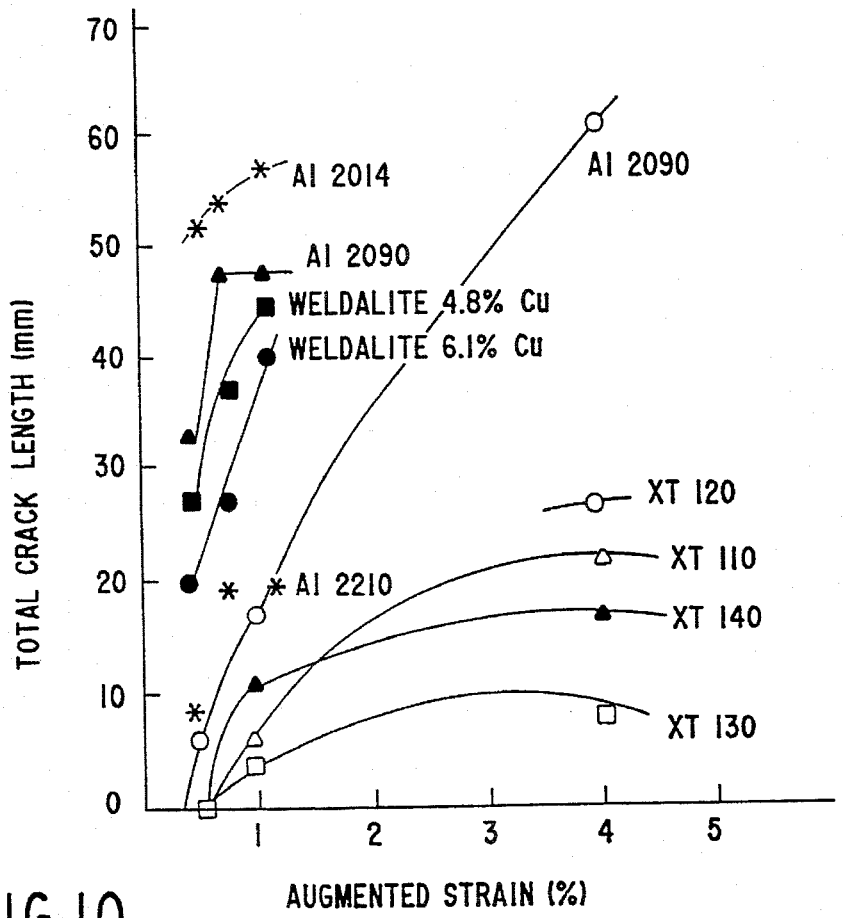
FIG. 10 is a plot of total crack length versus augmented strain from Table III.

FIG. 10 illustrates the superior weldability performance of Alloys 1 to 4 prepared by the methods of the invention compared to the weldability performance of other weldable Al-Li alloys and conventional aluminum alloys.

Laser weldability evaluations were carried out on Alloy 1 in the as-extruded condition. It was found possible to produce uncracked weld beads with this technique if the laser bursts were programmed for two low power pulses for preheating, one high power pulse for welding followed by two pulses of decreasing power to reduce the cooling rate.

At the yield strength levels achieved by the conventional aluminum alloys they are designated to replace (i.e., 2000 and 7000 series alloys), current Al-Li alloys with total impurity contents on the order of 5–10 ppm exhibit low fracture tough properties, particularly in the trough-thickness orientation.

Variations in toughness and strength properties are possible in Al-Li alloy systems by manipulation of such variables as alloy composition (Li, Cu, Mg), degree of cold work (e.g., percentage stretch between solution treat and age) and the aging practice (temperature and time). By necessity, there is usually a trade-off between toughness and strength, i.e., an increase in toughness can be achieved at the expense of yield strength and vice-versa. These manipulations do nothing to change the inherent toughness/strength relationship of a particular alloy composition.

Al-Li alloy products of the first embodiment of the present invention with less than 1.0 ppm each of the alkali metal elements (Na, K, Rb and Cs) and less than 0.2 ppm hydrogen, demonstrate inherent toughness/yield strength relationships that are superior to those demonstrated by identical alloys with total alkali impurity contents in excess of 5 ppm and hydrogen contents in excess of 0.4 ppm.

In FIGS. 27A, 27B, 28A, and 28B and Table V, data is presented for alloys of 2090 composition (2.0% Li, 2.4% Cu, 0.1% Zr) with total alkali impurity contents of approximately 1, 5, 10 and 100 ppm at a constant 0.2–0.3 ppm hydrogen content for two T8 aged conditions after 4% stretch; namely, 24 hours at 300° F. resulting in yield strengths of 60–65 Ksi; and 48 hours at 300° F. resulting in yield strengths of 65–70 Ksi. At both yield strength levels, reducing the total alkali content to <5 ppm leads to an increase in through-thickness toughness without any loss in yield strength, i.e., there is a significant change in the inherent toughness/yield strength relationship (Table IV).

TABLE IV

| | Total Alkali Content | |
|---|---|---|
| Centre Samples From 2.36" × 0.55" Extrusions | 1 ppm (Na + K) | 9 ppm (Na + K) |
| Aged 24 hours at 300° F. | | |
| Longitudinal Yield Strength | 62.2 Ksi | 60.3 Ksi |
| S-L Chevron-notch $K_{IV}$ Toughness | 30 Ksi √in | 18 Ksi √in |
| Aged 48 hours at 300° F. | | |
| Longitudinal Yield Strength | 69.0 Ksi | 65.2 Ksi |
| S-L Chevron-notch $K_{IV}$ Toughness | 20 Ksi √in | 12.5 Ksi √in |

TABLE V

| Cast Identity | Vaclite Code | Composition wt. % Li | Cu | Zr | wt. ppm Na | K | TS Aged Condition (°F./hrs) | 0.2% YS (Ksl) | S-L $K_n$ (Ksl √in) | S-L $K_{max}$ (Ksl √in) |
|---|---|---|---|---|---|---|---|---|---|---|
| 4091 | XT 110 | 2.42 | 1.99 | 0.09 | 0.32 | 0.46 | 300/48 | 68.7 | 18.8 | 18.6 |
| | | | | | | | 300/48 | 68.7 | 19.0 | 20.2 |
| 4090 | XT 110 | 2.23 | 1.95 | 0.09 | 0.41 | 0.42 | 300/24 | 62.2 | 30.6 | 30.6 |
| | | | | | | | 300/24 | 62.8 | 29.1 | 29.2 |
| | | | | | | | 300/48 | 69.6 | 19.5 | 18.8 |
| | | | | | | | 300/48 | 69.0 | 20.5 | 20.9 |
| 4094 | XT 110 | 2.30 | 2.04 | 0.07 | 0.95 | 0.24 | 300/24 | 60.1 | 32.9 | 32.9 |
| | | | | | | | 300/24 | 64.0 | 25.7 | 26.8 |
| | | | | | | | 300/48 | 68.7 | 21.2 | 21.5 |
| | | | | | | | 300/48 | 71.9 | 20.8 | 22.4 |
| 4109 | XT 110 | 2.51 | 2.01 | 0.08 | 2.5 | 2.1 | 300/24 | 61.4 | 23.9 | 26.4 |
| | | | | | | | 300/24 | 64.3 | 25.9 | 26.9 |
| | | | | | | | 300/48 | 64.0 | 26.1 | 27.2 |
| | | | | | | | 300/48 | 65.9 | 22.9 | 24.9 |
| 4111 | XT 110 | 2.53 | 1.99 | 0.08 | 7.2 | 1.6 | 300/24 | 59.3 | 18.4 | 19.3 |
| | | | | | | | 300/24 | 61.3 | 17.3 | 18.2 |
| | | | | | | | 300/48 | 64.2 | 12.9 | 13.1 |
| | | | | | | | 300/48 | 66.3 | 12.2 | 12.8 |
| 4112 | XT 110 | 2.38 | 2.10 | 0.08 | 97.6 | 4.8 | 300/24 | 58.5 | 12.7 | 13.8 |
| | | | | | | | 300/24 | 61.0 | 12.9 | 15.4 |
| | | | | | | | 300/48 | 65.5 | 13.2 | 14.2 |
| | | | | | | | 300/48 | 69.1 | 11.5 | 13.1 |

EXAMPLE 9

Five 2090 type test alloys (L to P) and seven 8090 type test alloys (E to K) including various amounts of alkali metal impurity were prepared and extruded into flat bar substantially as described above. The concentrations of the principal elements in those alloys in weight percent is presented in Table VI below. In addition, the 2090 alloy of Example 1 (Alloy 1) and the 8090 alloy of Example 2 (Alloy 2) are listed in Tables VI and VII and included in the comparison of mechanical properties.

TABLE VI

| Alloy | Composition of Major Alloying Elements in Al-Li Alloys (Weight Percent) Li | Cu | Ma | Zr | Sn | Fe | Si |
|---|---|---|---|---|---|---|---|
| E | 2.02 | 1.21 | 0.71 | 0.081 | | 0.05 | 0.031 |
| F | 2.02 | 1.21 | 0.71 | 0.082 | | 0.048 | 0.031 |
| G | 2.03 | 1.30 | 0.72 | 0.085 | 0.18 | 0.052 | 0.034 |
| H | 2.05 | 1.28 | 0.80 | 0.080 | | 0.053 | 0.031 |
| I | 2.01 | 1.18 | 0.76 | 0.082 | | 0.048 | 0.029 |
| J | 1.93 | 1.15 | 0.71 | 0.110 | | 0.050 | 0.031 |
| K | 1.94 | 1.25 | 0.64 | 0.072 | | 0.030 | 0.028 |
| L | 1.95 | 2.27 | 0.01 | 0.109 | | 0.051 | 0.028 |
| M | 2.00 | 2.45 | 0.01 | 0.101 | | 0.47 | 0.028 |
| N | 1.91 | 2.14 | 0.01 | 0.080 | 0.24 | 0.034 | 0.027 |
| O | 2.07 | 2.34 | 0.01 | 0.042 | | 0.025 | 0.023 |
| P | 2.04 | 1.94 | 0.01 | 0.048 | | 0.049 | 0.025 |
| 1 | 1.96 | 2.4 | 0.09 | 0.12 | — | 0.09 | 0.020 |
| 2 | 1.86 | 1.14 | 0.76 | 0.08 | — | 0.06 | 0.020 |

The concentration of alkali metal impurities and hydrogen in Alloys E to P were determined by GMDS in ppm and are presented in Table VII below:

TABLE VII

| Alloy | Composition of Alkali Metal Impurities (GDMS) and Hydrogen in ppm Na | K | Rb | Cs | H (bulk) |
|---|---|---|---|---|---|
| E | 2.02 | 1.72 | <0.02 | <0.04 | 0.74 |
| F | 2.50 | 0.60 | ≠ | ≠ | 0.17 |
| G | 4.21 | 0.25 | ≠ | ≠ | 0.27 |
| H | 5.3 | 0.58 | ≠ | ≠ | 0.30 |
| I | 34.7 | 0.33 | ≠ | ≠ | 0.30 |
| J | 12.1 | 0.55 | ≠ | 0.013 | 4.6 |
| K | 8.9 | 0.16 | ≠ | 0.004 | 0.25 |
| L | 4.6 | 0.2 | ≠ | ≠ | 0.23 |
| M | 4.2 | 0.2 | ≠ | ≠ | 6.2 |
| N | 1.83 | 0.74 | ≠ | ≠ | 0.2 |
| O | 3.4 | 0.74 | ≠ | ≠ | 0.42 |
| P | 122 | 39.0 | ≠ | ≠ | 0.33 |
| 1 | 0.42 | 0.34 | ≠ | ≠ | 0.14 |
| 2 | 0.54* | 0.20* | ≠ | ≠ | 0.12 |

Figure 13:
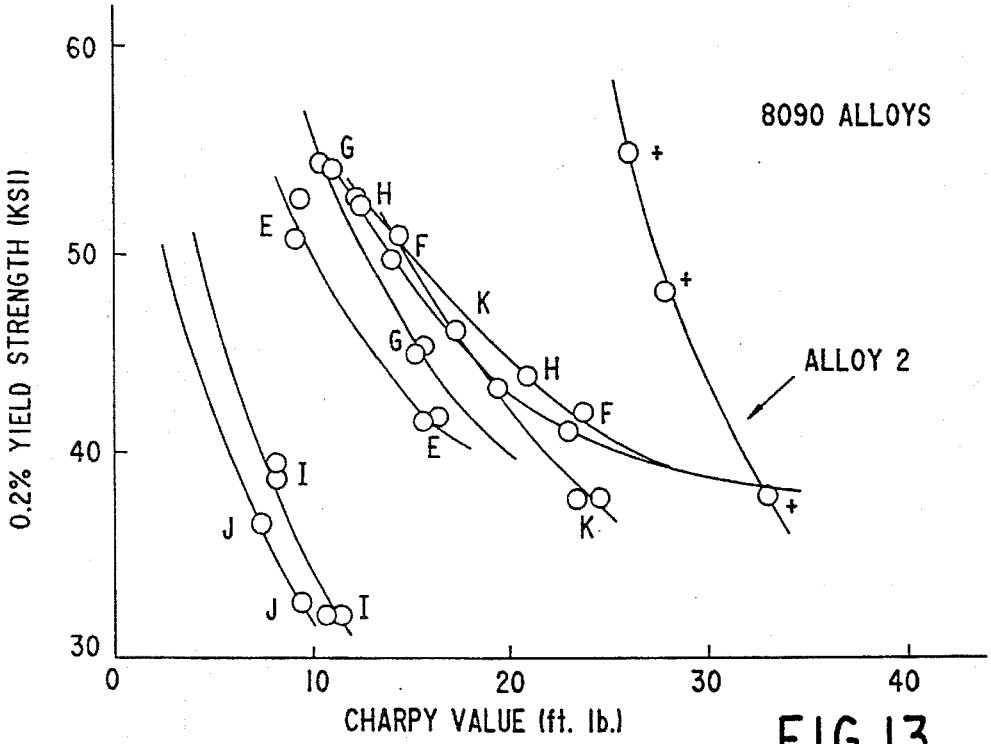
Figure 14:
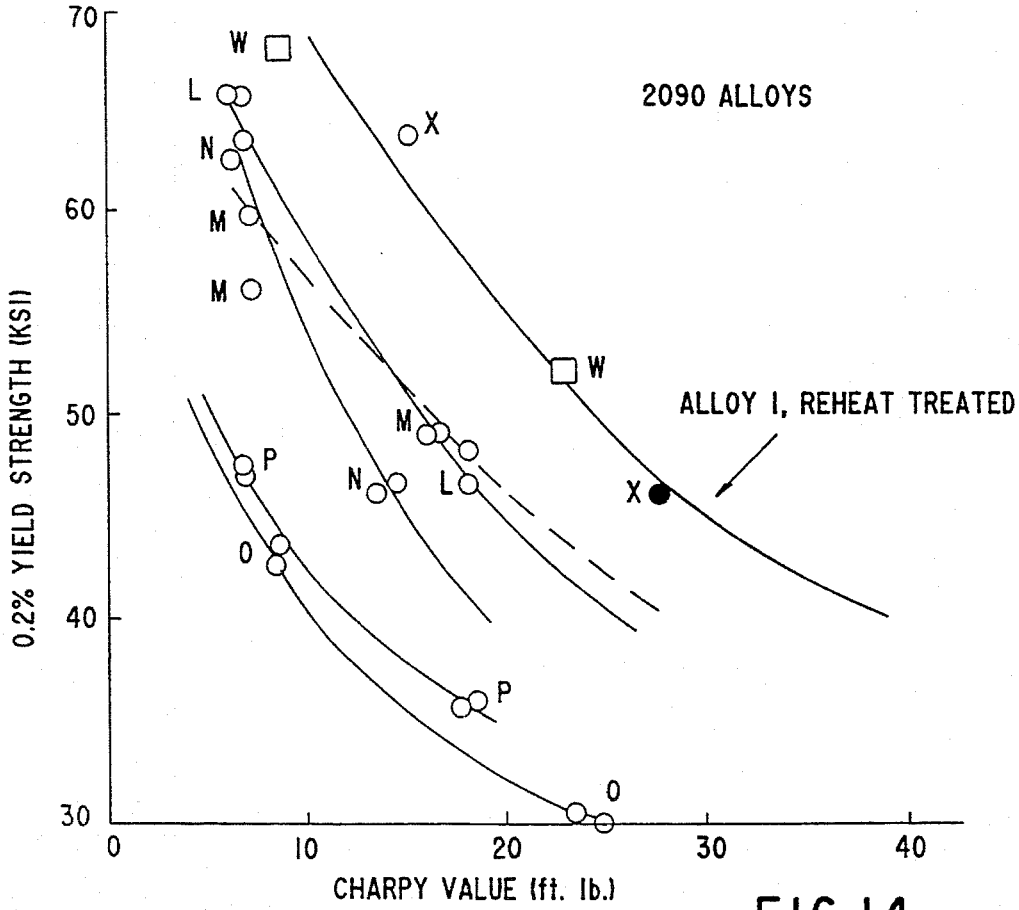
Figure 15:
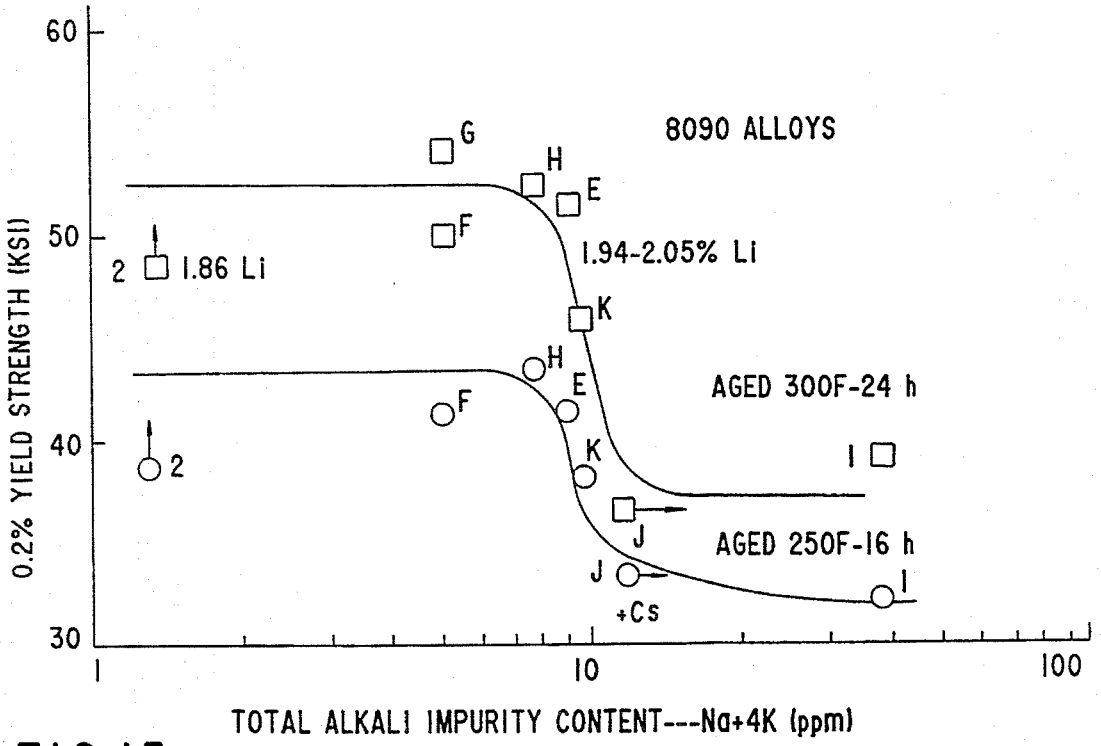
FIGS. 15 and 16 are plots of 0.2% yield strength versus alkali metal impurity (Na+4K) for test alloys 1(2090), 2(8090) and E to P.
Figure 16:
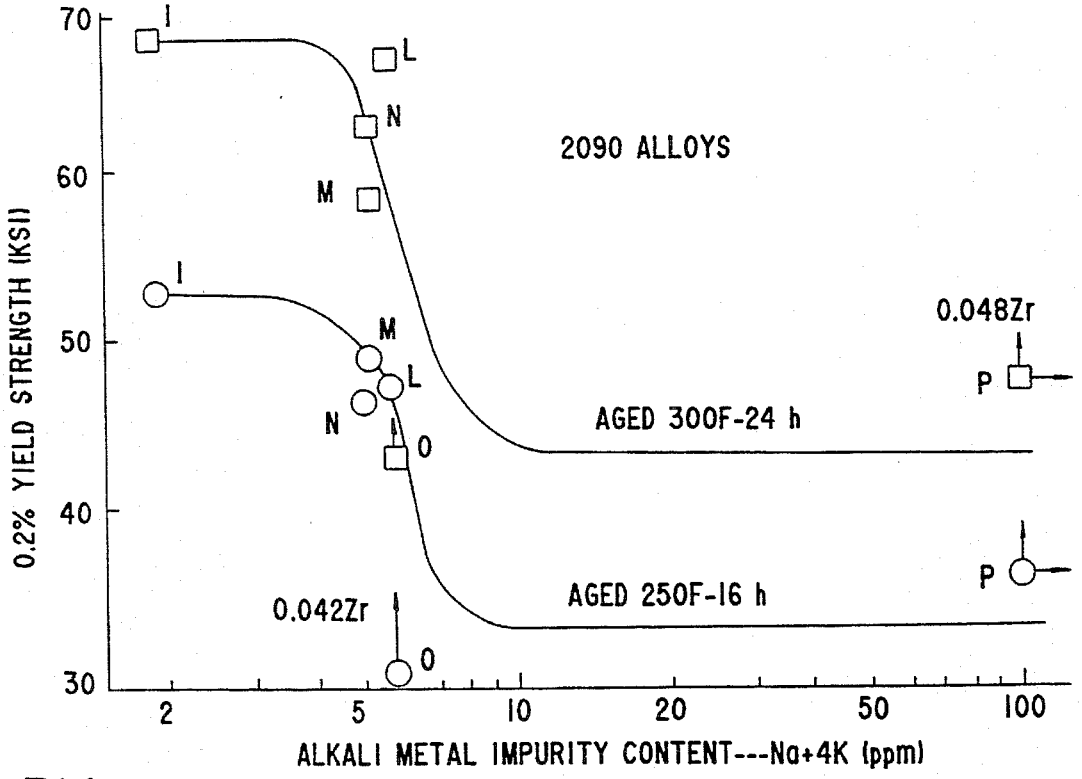
Figure 17:
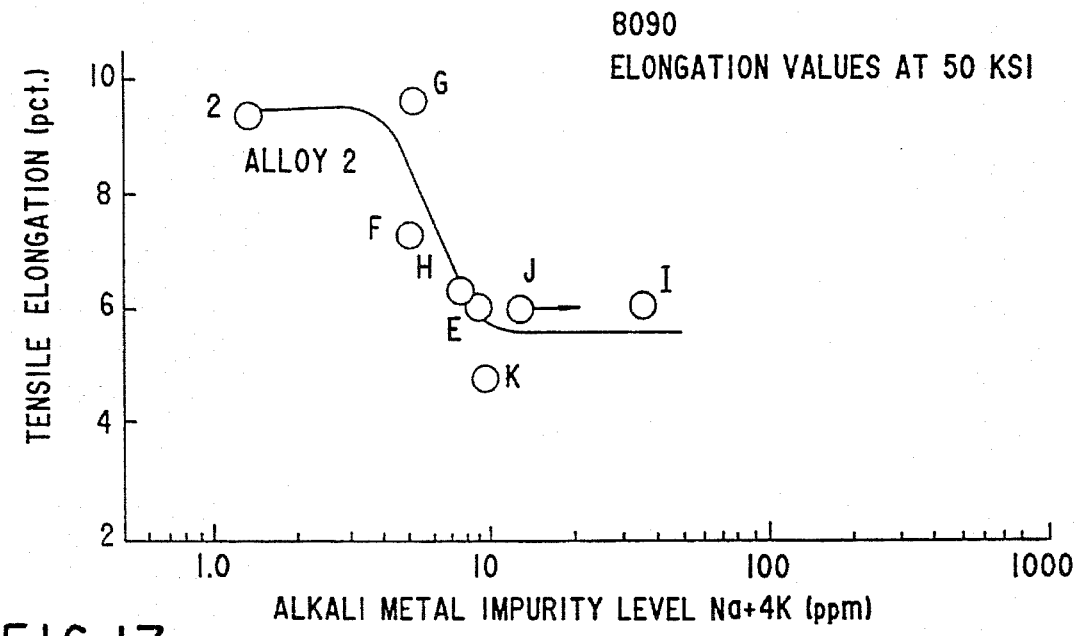
FIGS. 17 and 18 are plots of elongation percent versus alkali metal impurity (Na+4K) for test alloys 1(2090), 2(8090) and E to P.
Figure 18:
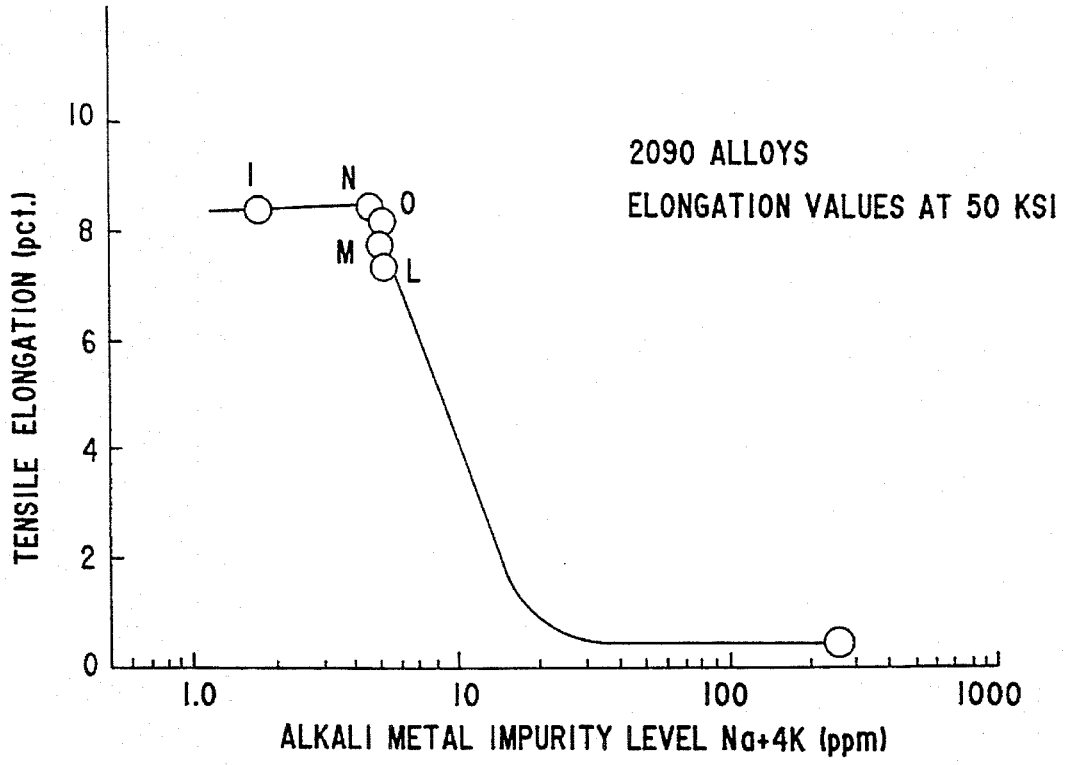
Figure 19:
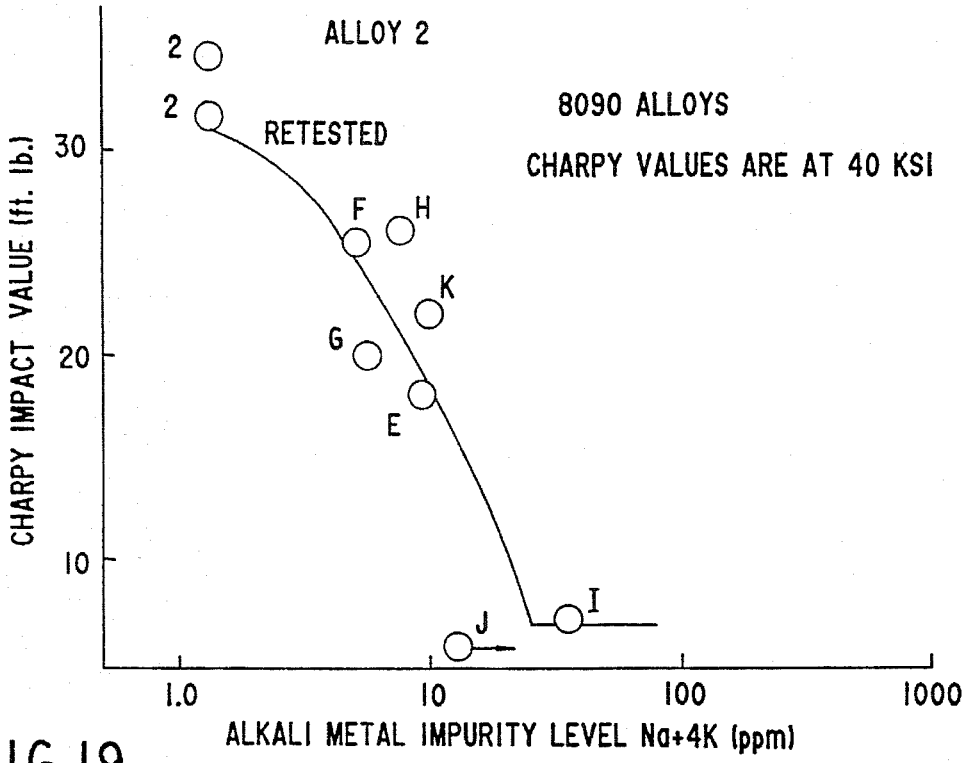
FIGS. 19 to 22 are plots of Charpy impact valves versus alkali metal impurity (Na+4K).
Figure 20:
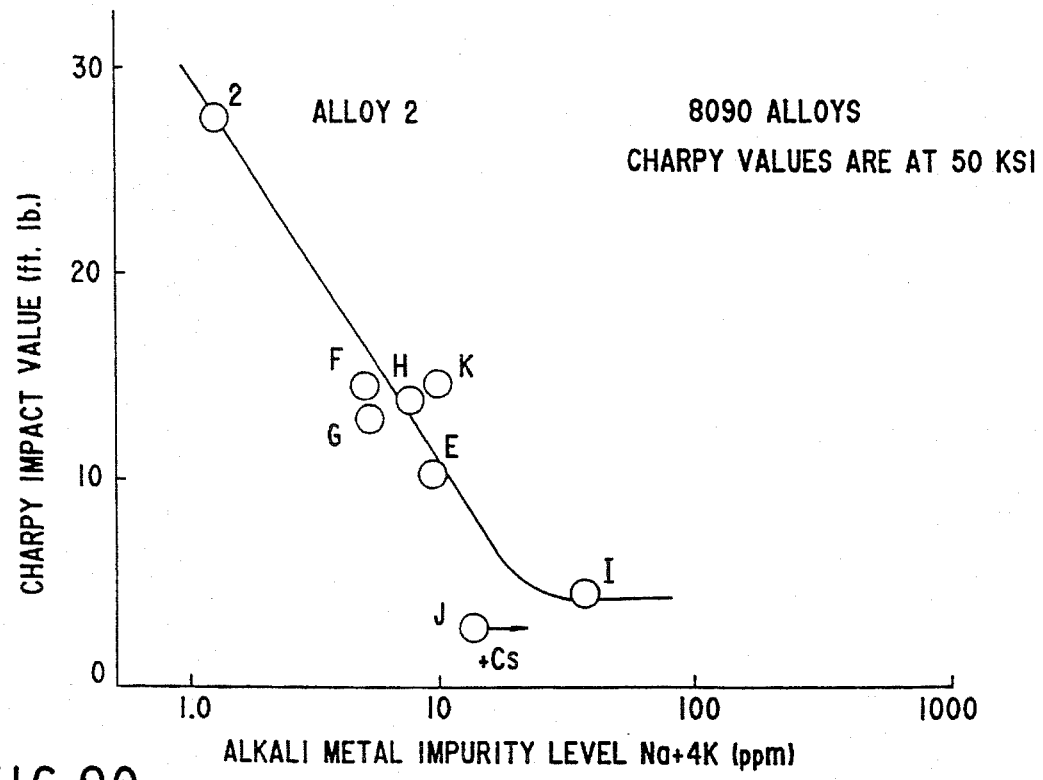
Figure 21:
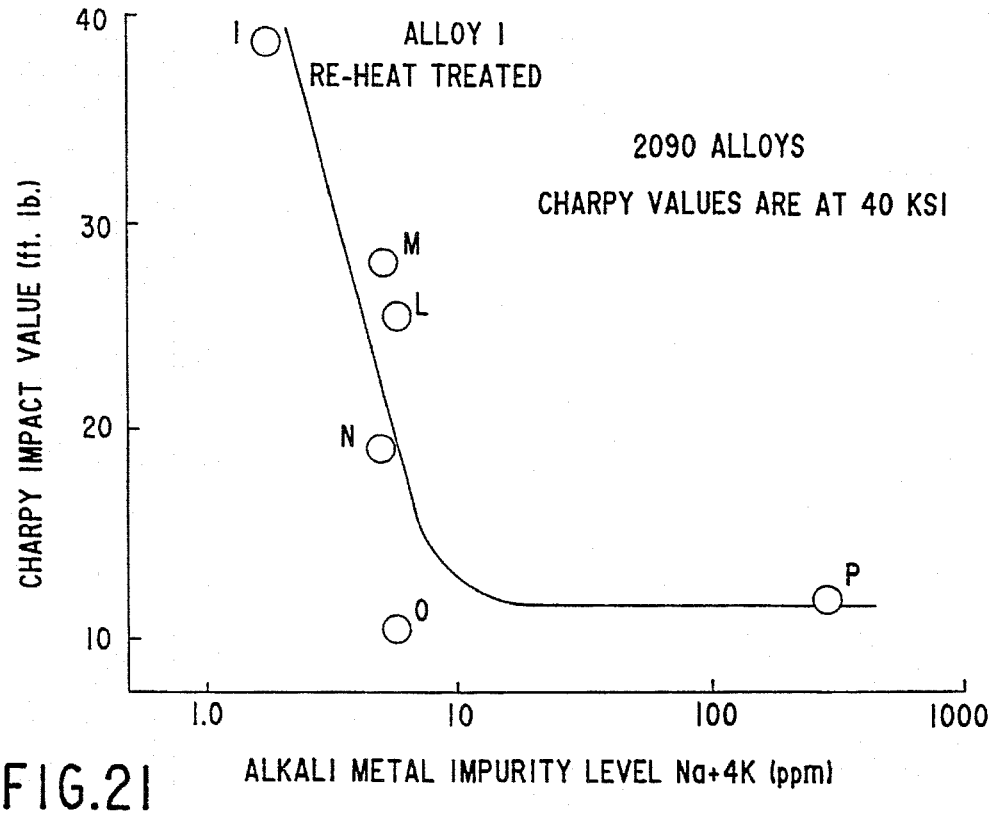
Figure 22:
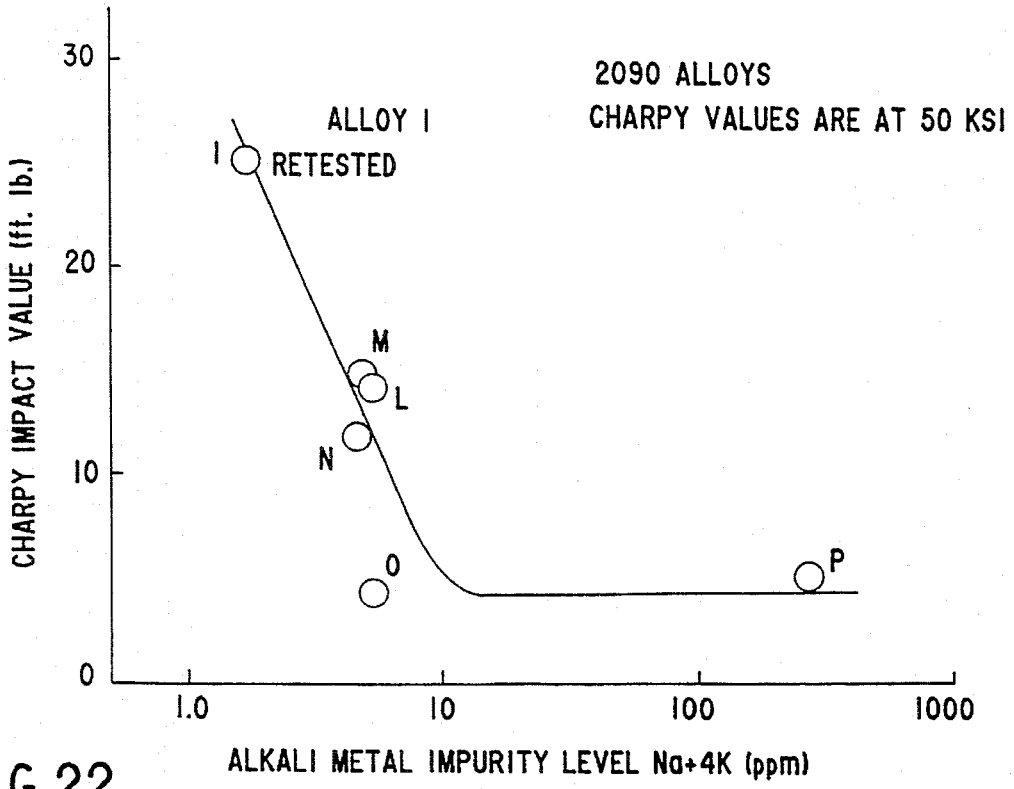

*Estimated time from the average of 3 similar alloys made at the same time with the same procedure
≠ Below GDMS detection limits The mechanical properties of test alloys E to P, including elongation percent, 0.2% yield strength and Charpy impact values were measured and are plotted in FIGS. 13 and 14. Na+4K, instead of Na+K, is plotted against mechanical properties in FIGS. 15 to 22 because although Na is the predominant impurity, the amount of liquid present in grain boundary regions at room temperature depends strongly on the K concentration because Na is solid at room temperature and the eutectic ratio for Na and K which produces the most liquid for a given weight of impurity and is, therefore, the most embrittling ratio, is about 1 Na:4K. In FIGS. 11 to 22, the 0.2% yield strength is plotted against elongation percent or Charpy values for Alloys 1 and 2 and test alloys E to P grouped according to type.

The data presented in these graphs demonstrates that in each instance, increased alkali metal impurities caused a deterioration in 0.2% yield strength, elongation percent and Charpy values versus the 2090 and 8090 test alloys.

The plots of yield strength and tensile elongation versus alkali metal impurity in FIGS. 15 to 18 show two critical points A and B which are illustrated schematically below:

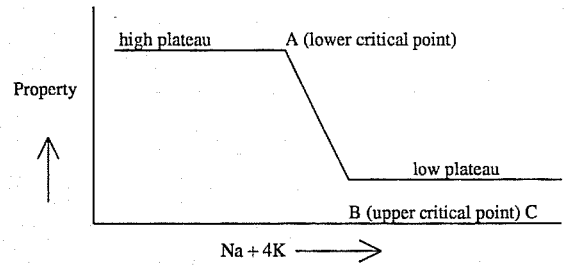

If the initial composition of an alloy is point C, then a refining process should reduce impurities below point B to be useful. If the initial composition of an alloy is below point B, then any degree of refining will be immediately effective. Increasing degrees of refinement will continue to improve properties until point A is reached, at which time the properties will maintain their high values but no further improvement will occur. Commercial Al-Li alloys are usually in the range A-B. In the case of toughness, the lower critical point has not been reached in any of the alloys made so far. This means that the Na+4K levels are less than about 1 ppm and the Na+K levels are less than about 0.8 ppm. This suggests that further refinement will continue to improve toughness.

The high plateaus on the yield strength and tensile elongation plots in FIGS. 15 to 18 suggest a region at about 3 ppm Na+4K (e.g., about 1.9 Na+K) where further reductions in alkali metal impurity has reached a point of diminishing returns for improvement in these properties. However, toughness appears to improve continuously with lower alkali metal impurity levels. For ease of reference, alkali metal impurity levels estimated from the data presented in FIGS. 11 to 22 above which degradation of mechanical properties will occur are listed in Table VIII below.

TABLE VIII

Critical Impurity Levels for Mechanical Property Improvements in Plat Bar Extrusions

| | | Critical Impurity Level (ppm) | | |
|---|---|---|---|---|
| Property | Alloy | Na + 4K | Na-K at 4:1 ratio | Na-K at 10:1 ratio |
| 0.2% Y.S. | 8090 | 5 | 3.1 | 3.9 |
| 0.2% Y.S. | 2090 | 3 | 1.9 | 2.4 |
| El % | 8090 | 3 | 1.9 | 2.4 |
| El % | 2090 | 3 | 1.9 | 2.4 |
| Charpy | 8090 | <1 | <0.63 | 0.8 |
| Charpy | 2090 | <1 | <0.63 | 0.8 |

Unlike tensile strength and elongation percent, the impact toughness appears to improve continuously with lower alkali metal impurity levels.

Figure 23:
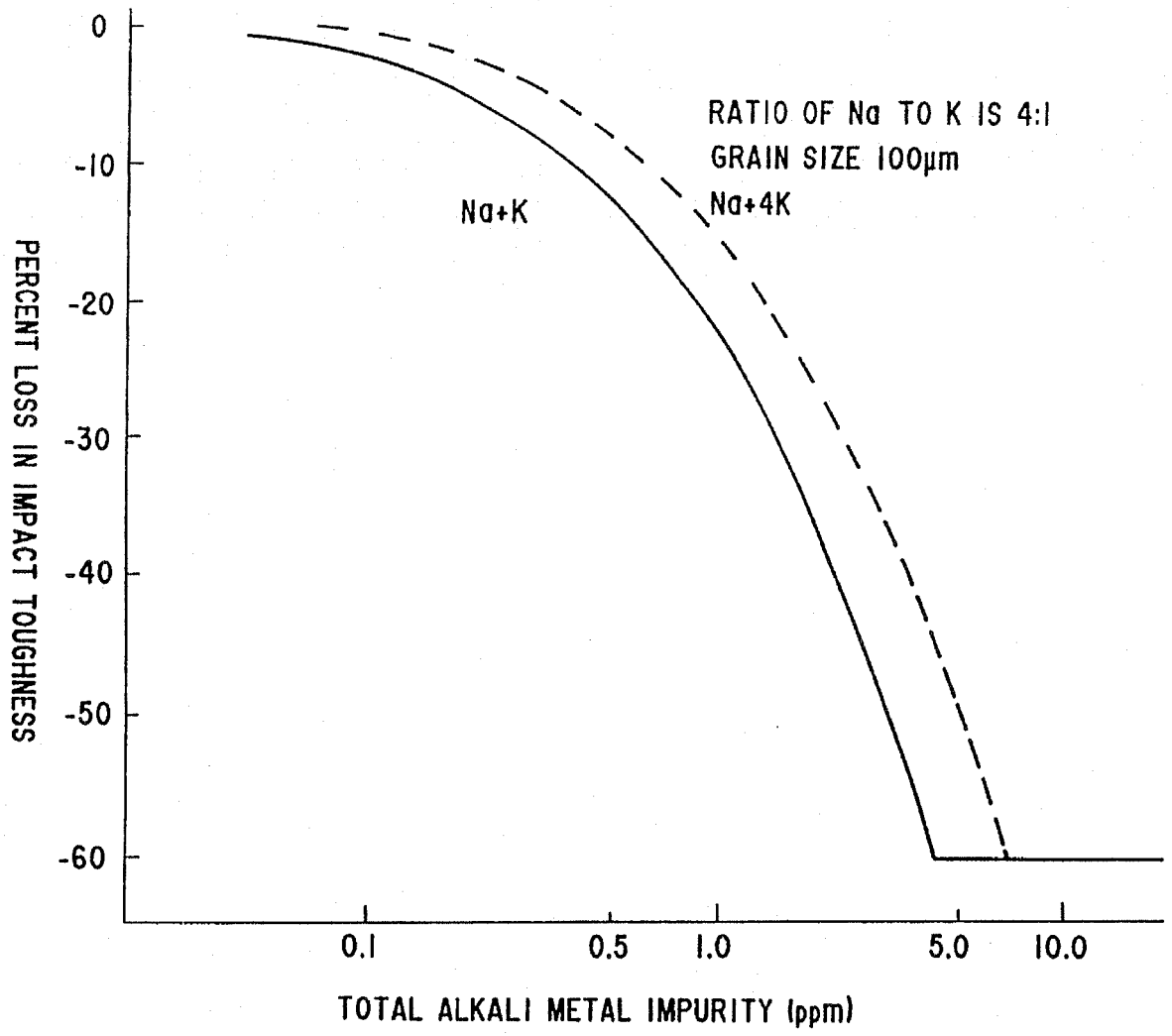
FIG. 23 is a plot of a calculated loss in toughness versus total alkali metal impurity.

FIG. 23 is a plot of impact toughness calculated in accordance with D. Webster, *Proceedings of the Fifth Al-Li Conference,* Williamsburg, Va., U.S.A., pp. 519–528 (1989), versus alkali metal content (Na+K and Na+4K) assuming a surface energy reduction mechanism and using the Na-K gain boundary particles in Al-Li alloys as shown in FIG. 13. The results of this calculated data are similar to the actual data presented in FIGS. 19 to 22.

In another aspect, the invention also relates to improving the physical properties of alloys that form liquid grain boundary phases at ambient temperature due to alkali metal impurities in alloys such as Al-Li, Al-Mg and Mg-Li metallic products, and more particularly to methods for increasing the toughness, corrosion cracking resistance and ductility of such products without loss of strength.

The magnesium-lithium family of alloys when manufactured by conventional techniques are known to suffer from stress corrosion cracking, overaging, instability and creep at low temperatures. Razin et al., *Advanced Materials & Processes,* Vol. 137, Issue 5, pp. 43–47 (May 1990). Some of the problems in Mg-Li alloys have been associated with alkali metal impurities, and it has been observed that Na levels above 20 ppm reduced room temperature ductility. Payne et al., *JIM,* Vol. 86, pp. 351–352 (1957–58). Some Mg-Li alloy specifications set the Na limit to less than 20 ppm for wrought products and 10 ppm for castings.

Preferably, the process also reduces gas impurities such as hydrogen and chlorine and reduces the formation of detrimental oxides. The processing technique involves subjecting the molten alloy to conditions that remove alkali metal impurity, e.g., a reduced pressure for a sufficient time to reduce the aggregate concentration alkali metal impurities to less than about 5 ppm, preferably less than about 3 ppm, and more preferably less than 1 ppm. Generally, the best observed results occurred at less than 0.8 and 0.5 ppm. It has also been found that the presence of certain combinations of alkali metal impurities in relative proportions which form low melting point eutectic mixtures requires removal of alkali metal impurities to levels below the higher level, e.g., 5 ppm, mentioned above to achieve the property improvement provided by this invention. It is believed that this is because the eutectic mixtures remain liquid and they cause embrittlement at temperatures well below room temperature. Certain combinations of Na, K and Cs are known to remain liquid down to –78° C.

EXAMPLE 10

Three Al-Mg test alloys A, B and C were prepared to demonstrate the utility of the invention with such alloys by melting commercial 5083 alloy. Alloy A was air melted to simulate commercial practice and contained about 1 ppm Na. Alloy B was vacuum melted and refined to reduce the alkali metal content to below Na levels detectable by emission spectroscopy. Alloy C was melted under argon and doped with Na and K to produce an alloy including about 235 ppm Na. Only the Na content of Alloys A, B and C were measured.

Samples of Alloys A, B and C were cast in 5-inch diameter molds and extruded to 1-inch round bar at 800° C. and aged at 300° F. for 4 hours. The tensile and impact properties of the aged bars were then tested.

Samples of Alloys A, B and C were also cast into 1-inch thick slab ingots and hot rolled at 480° C. to plate and sheet. Samples at various thicknesses were then evaluated for appearance.

Figure 24:
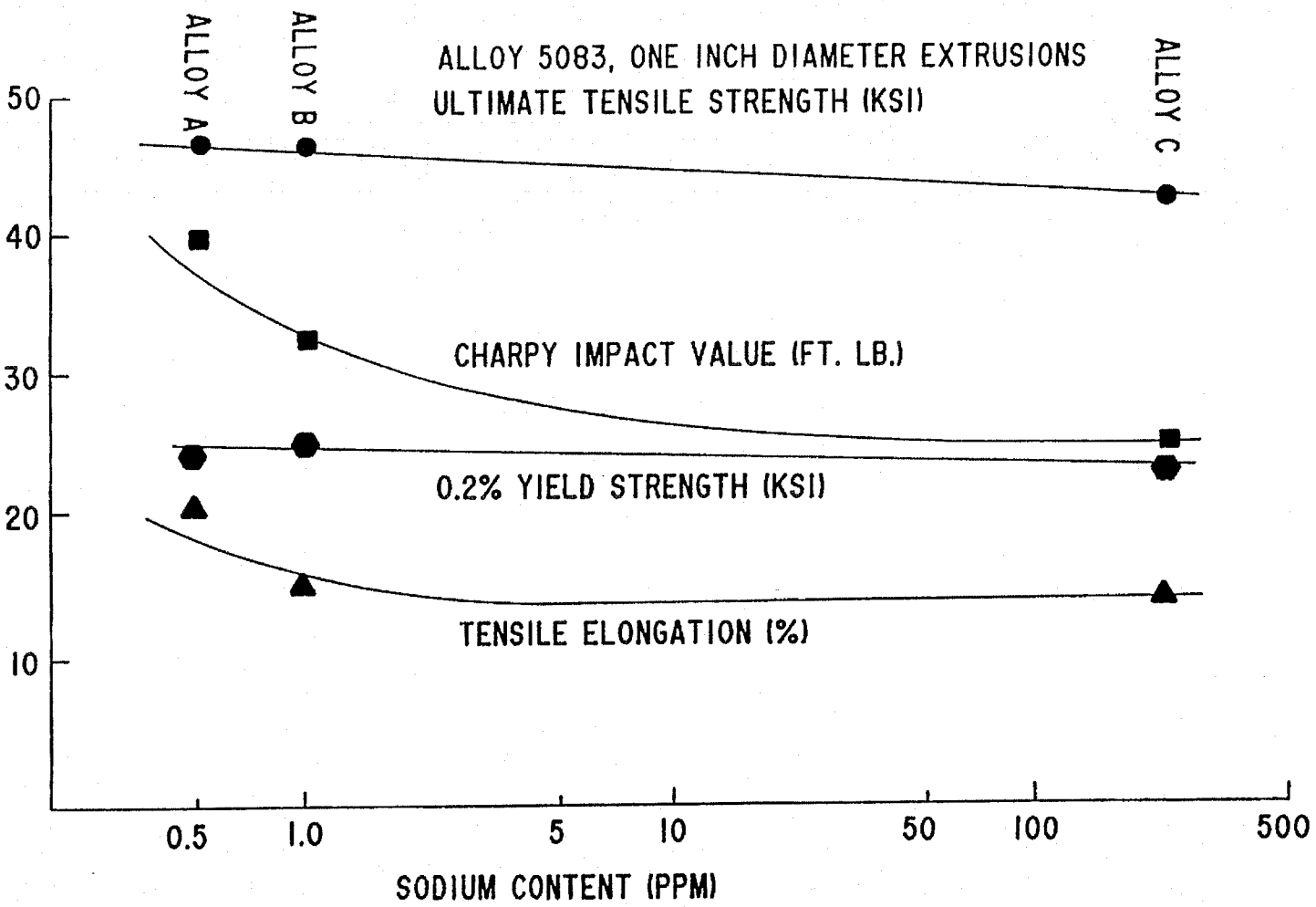
FIG. 24 is a plot of the mechanical properties modified 5083 alloys A, B and C.

FIG. 24 is a plot of the ultimate tensile strength, Charpy impact value, 0.2% yield strength and elongation percent of Alloy A, B and C extrusions as a function of Na content. The data presented in FIG. 24 suggests that elongation and toughness are greatest at the lowest Na levels. The changes in yield strength are small. The ultimate tensile strength increases at low Na levels because of the greater ductility of the higher purity alloys.

The rolling behavior of Alloy A, B and C slab ingots was evaluated, and the results are summarized in Table IX.

TABLE IX

The Effect of Impurity Level on the Hot Rolling Characteristics of 5083 Plate

| Rolling Step | Alloy A (<1 ppm Na) | Alloy B (<1 ppm Na) | Alloy C (235 ppm Na) |
|---|---|---|---|
| 23-18 mm | No cracking | No cracking | Severe cracking and delamination on the first pass |
| 18-9 mm | Severe edge cracking* | No cracking | Rolling discontinued |
| 9-6 mm | Severe edge cracking | Very slight edge cracking | |

*Edges machined to a crack-free condition and rolling was continued

The rolling properties varied significantly with Na concentration. Alloy C slab ingot with 235 ppm Na could not be hot rolled under any conditions without serious cracking and delamination. Alloy A slab ingot could be rolled but not without significant edge cracking. In contrast, vacuum-melted Alloy B rolled satisfactorily with little edge cracking.

EXAMPLE 11

Mg-Li Alloys X, Y and Z having the compositions set forth in Table X below were vacuum refined as described below.

TABLE X

Composition of Magnesiinn-Lithium Alloys

| Alloy | Li wt. % | Al wt. % | Mg wt. % | Fe wt. % | Si wt. % | Na ppm | K ppm | Cs ppm | Rb ppm |
|---|---|---|---|---|---|---|---|---|---|
| X | 6.1 | 3.4 | bal. | 0.024 | 0.045 | 4.4 | 2.00 | 1.1 | 0.04 |
| Y | 14.7 | 0.13 | bal. | 0.003 | 0.012 | 7.33 | 5.00 | 1.1 | 0.01 |
| Z | 18.8 | 0.17 | bal. | 0.008 | 0.098 | 10.0 | 2.50 | 1.4 | 0.01 |

Figure 25:
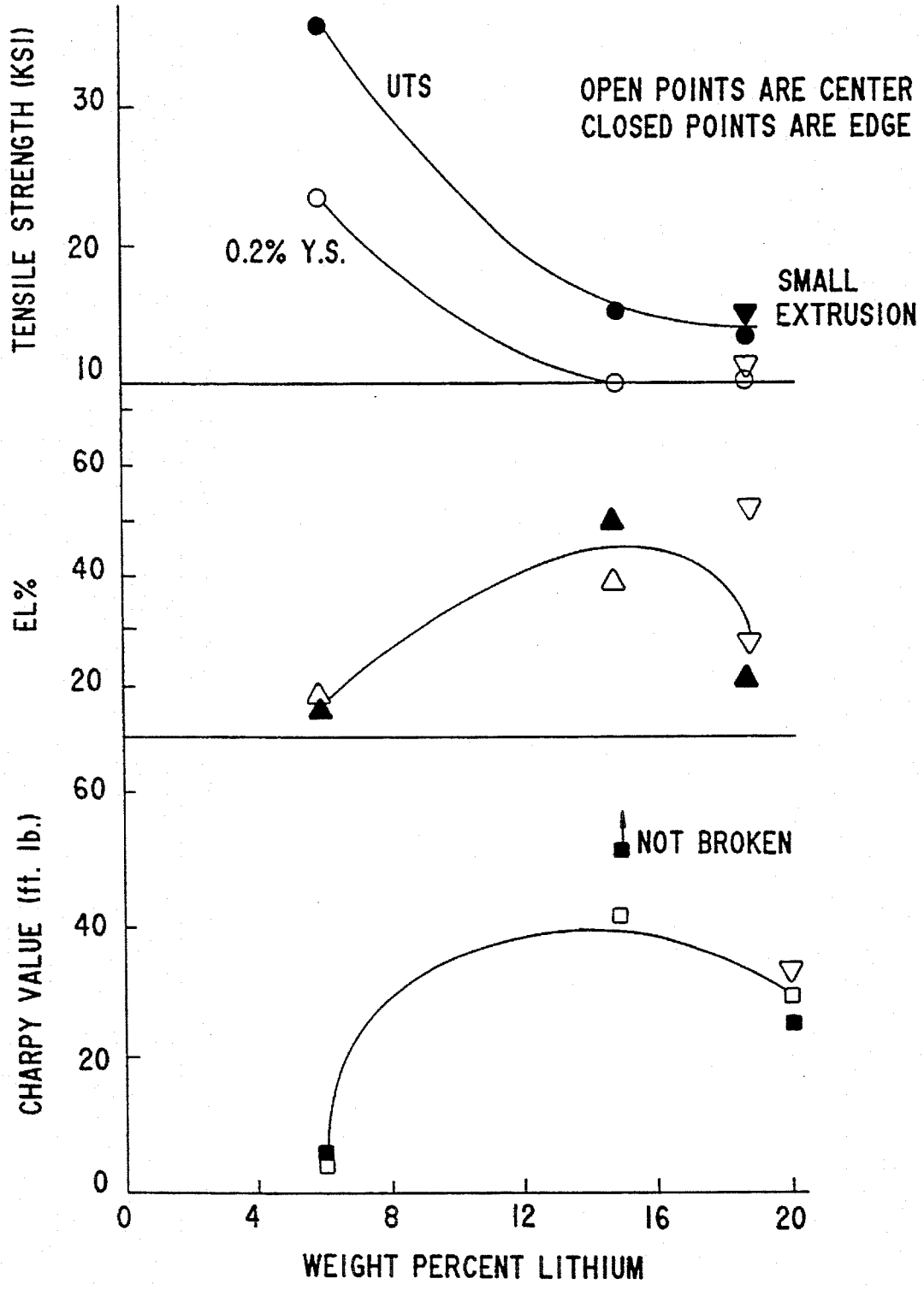
FIGS. 25 and 26 are plots of the mechanical properties of Mg-Li alloys X, Y and Z.
Figure 26:
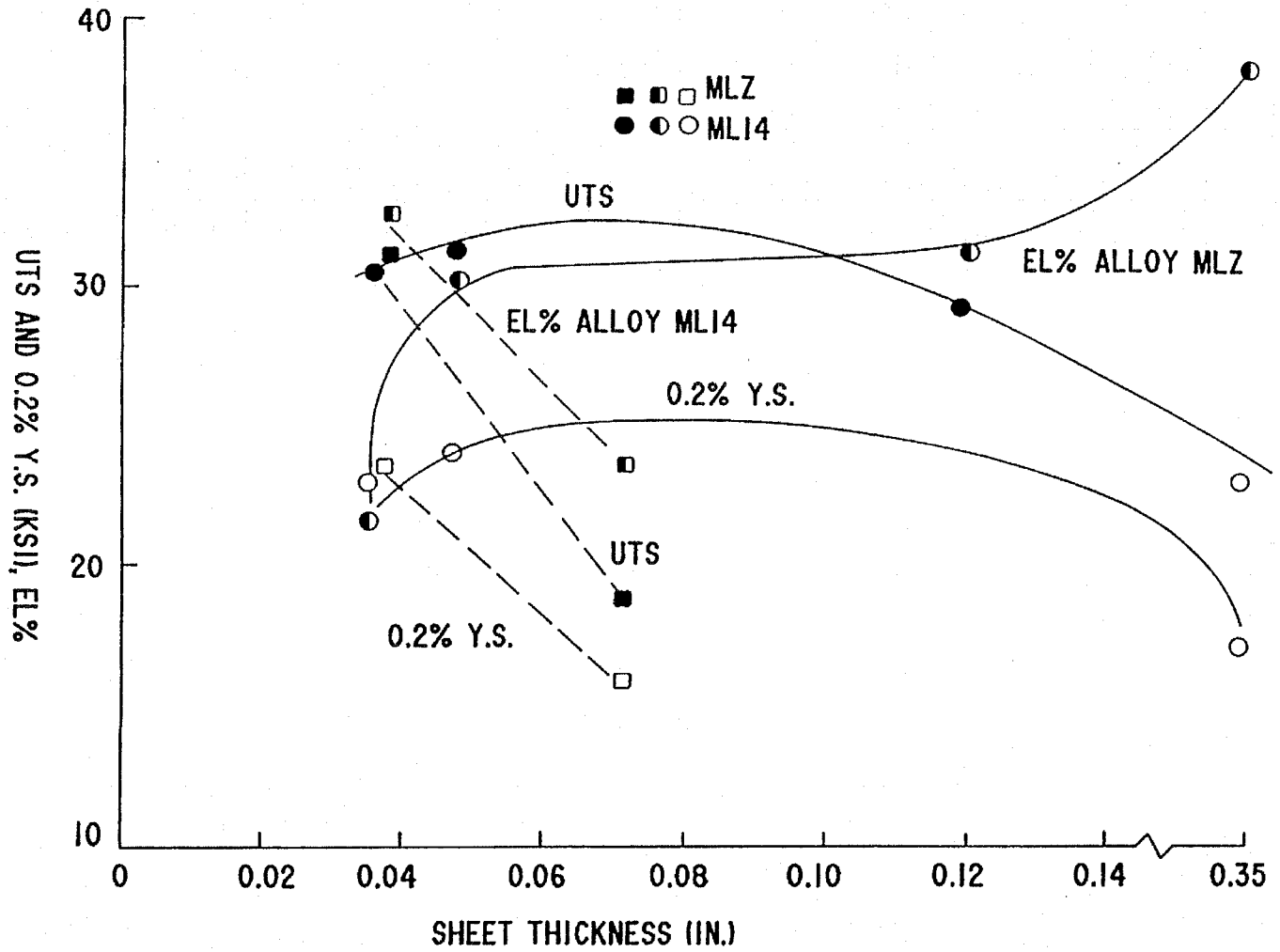

Due to the high volatility of Mg, these alloys could not be simply melted and vacuum refined. First, an initial melt of about 60 wt. % Mg and 40 wt. % Li was made at about 400° C. and then the melt was further heated to about 500° C. and refined under vacuum for about 20 minutes to reduce alkali metal impurities. Thereafter, the Mg necessary to make the desired alloy composition was added under vacuum and the temperature was raised to 630° C. under vacuum to further reduce the alkali metal impurities. At about 600° C., the vacuum was replaced by an argon atmosphere (400 mm Hg) to reduce Mg loss and the melts were cast under argon. The casts were extruded into flat bar. The toughness and tensile properties of the flat bar extrusions and cold rolled sheets were measured and the results are summarized in Table XI below and in FIGS. 25 and 26. The toughness and ductility of Alloys X, Y and Z are excellent, but the Na and K levels may be further reduced and the mechanical properties improved by increasing the refining times to further reduce the impurity levels.

TABLE XI

Mechanical Properties of Mg-Li Flat Bar Extrusions in the As-Extruded Condition

| Li Content (wt. %) | Extrusion Size | Specimen Position | UTS (ksi) | 0.2% Y.S. (ksi) | El. % | Charpy Value ft. lb. |
|---|---|---|---|---|---|---|
| 6.1 | 3 × ½ | edge | 36.6 | 24.1 | 16 | 6.1 |
| 6.1 | 3 × ½ | center | 35.9 | 23.4 | 18 | 5.6 |
| 14.7 | 3 × ½ | edge | 15.4 | 10.3 | 50 | 51.1 not broken |
| 14.7 | 3 × ½ | center | 15.1 | 10.0 | 40 | 42 |
| 18.8 | 3 × ½ | edge | 13.3 | 10.2 | 22 | 27.1 |
| 18.8 | 3 × ½ | center | 13.7 | 10.1 | 27 | 31.3 |
| 18.8 | 1 × 0.3 | edge | | | | 34.1 |
| 18.8 | 3 × ½ | center | 15.5 | 10.9 | 53 | 34.3 |

What is claimed is:

1. A process for making a high strength, high toughness magnesium alloy comprising the steps of preparing a melt comprised of magnesium and lithium metals including a total of more than 5 ppm of alkali metal impurities selected from the group consisting of sodium, potassium, rubidium and cesium; and reducing the alkali metal impurities by vacuum refining so that the total concentration of said alkali metal impurities in the alloy is less than about 5 ppm.

2. A process for preparing a high strength magnesium alloy comprising heating a melt comprised of a base metal of magnesium, greater than 0.5% of lithium, and at least one alkali metal impurity selected from the group consisting of sodium, potassium, rubidium and cesium, the total alkali metal present in an amount greater than 5 ppm, to a temperature of about 50° to 200° C. above the melting point of alloy being refined in a vacuum for a sufficient time to reduce the aggregate concentration of alkali metal impurities in the melt to less than about 5 ppm as measured by GDMS.

3. The process of claim 2 wherein the aggregate concentration of alkali metal impurities is reduced to less than about 3 ppm.

4. The process of claim 2 wherein the aggregate concentration of alkali metal impurities is reduced to less than about 1 ppm.

5. The process of claim 2 wherein the aggregate concentration of alkali metal impurities is reduced to less than about 0.5 ppm.

6. The process of claim 2 wherein the vacuum is less than about 200 μm Hg and the temperature is about 50° to about 100° C. above the melting point of the alloy being refined.

7. The process of claim 2 wherein the hydrogen concentration in the melt is reduced to less than about 0.2 ppm, measured by LECO fusion technique.

8. The process of claim 2 wherein the hydrogen concentration in the melt is reduced to less than about 0.1 ppm, measured by LECO fusion technique.

9. The process of claim 2 further comprising the step of purging the melt with an inert gas.

* * * * *